US012221977B2

(12) United States Patent
Wang et al.

(10) Patent No.: US 12,221,977 B2
(45) Date of Patent: Feb. 11, 2025

(54) FAN APPARATUS AND AIR CONDITIONER OUTDOOR UNIT

(71) Applicants: GD Midea Heating & Ventilating Equipment Co., Ltd., Foshan (CN); Midea Group Co., Ltd., Foshan (CN)

(72) Inventors: Qizhen Wang, Shanghai (CN); Yuefei Li, Shanghai (CN); Naitong Liu, Shanghai (CN); Feng Yang, Shanghai (CN); Yandong Wu, Shanghai (CN); Zhenjiang Zhan, Shanghai (CN); Longxin Zhang, Shanghai (CN); Weitao Chen, Shanghai (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 24 days.

(21) Appl. No.: 17/992,806

(22) Filed: Nov. 22, 2022

(65) Prior Publication Data

US 2023/0078022 A1 Mar. 16, 2023

Related U.S. Application Data

(63) Continuation of application No. PCT/CN2021/121841, filed on Sep. 29, 2021.

(30) Foreign Application Priority Data

Oct. 10, 2020 (CN) ..... 202011080566.1
Oct. 10, 2020 (CN) ..... 202022248414.X

(51) Int. Cl.
*F04D 19/02* (2006.01)
*F04D 25/08* (2006.01)
(Continued)

(52) U.S. Cl.
CPC ..... *F04D 29/38* (2013.01); *F04D 25/08* (2013.01); *F04D 25/166* (2013.01);
(Continued)

(58) Field of Classification Search
CPC ..... F04D 19/024; F04D 19/02; F04D 19/022; F04D 19/007; F04D 29/384;
(Continued)

(56) References Cited

U.S. PATENT DOCUMENTS 6,099,249 A * 8/2000 Hashimoto ..... F01D 5/142 415/181
7,874,796 B2 * 1/2011 Chang ..... F04D 19/007 415/199.1
(Continued)

FOREIGN PATENT DOCUMENTS

CN 204458511 U 8/2015
CN 204900286 U 12/2015
(Continued)

OTHER PUBLICATIONS

Midea Group Co., Ltd., ISR, PCT/CN2021/121841, Dec. 1, 2021, 3 pgs.
(Continued)

*Primary Examiner* — Woody A Lee, Jr.
*Assistant Examiner* — Behnoush Haghighian
(74) *Attorney, Agent, or Firm* — Morgan, Lewis & Bockius LLP

(57) ABSTRACT

Disclosed are a fan apparatus and an air conditioner outdoor unit. The fan apparatus includes: a first wind wheel and a second wind wheel, axially arranged in an interval. A spacing S1 between the first wind wheel and the second wind wheel satisfies S1<(H1+H2)/2, where H1 is a length of the first wind wheel along the axial direction, and H2 is a length of the second wheel along the axial direction.

18 Claims, 20 Drawing Sheets

(51) Int. Cl.

| | |
|---|---|
| ***F04D 25/16*** | (2006.01) |
| ***F04D 29/38*** | (2006.01) |
| ***F04D 29/54*** | (2006.01) |
| ***F24F 1/38*** | (2011.01) |
| *F01P 5/02* | (2006.01) |
| *F04D 19/00* | (2006.01) |

(52) U.S. Cl.
CPC ..... *F04D 29/541* (2013.01); *F24F 1/38* (2013.01); *F01P 2005/025* (2013.01); *F04D 19/007* (2013.01); *F04D 19/024* (2013.01); *F04D 29/384* (2013.01)

(58) Field of Classification Search
CPC .. F04D 29/541; F04D 29/5826; F04D 29/644; F04D 29/542; F04D 29/544; F04D 25/0606; F01P 2005/025; F01P 5/06; F01P 11/10
See application file for complete search history.

(56) References Cited

U.S. PATENT DOCUMENTS

| | | | | |
|---|---|---|---|---|
| 8,029,236 | B2 * | 10/2011 | Chang | F04D 29/544 415/199.5 |
| 8,348,593 | B2 * | 1/2013 | Yoshida | F04D 19/024 416/223 R |
| 8,690,528 | B2 * | 4/2014 | Kato | F04D 29/544 415/199.5 |
| 11,506,211 | B2 * | 11/2022 | Li | F04D 29/329 |
| 2007/0286720 | A1 * | 12/2007 | Chang | F04D 19/007 415/198.1 |
| 2010/0054931 | A1 * | 3/2010 | Yoshida | F04D 19/024 415/199.5 |
| 2013/0051997 | A1 * | 2/2013 | Uchiyama | F04D 29/384 415/193 |
| 2016/0305452 | A1 | 10/2016 | Nakagawa et al. | |
| 2021/0388839 | A1 * | 12/2021 | Li | F04D 29/386 |

FOREIGN PATENT DOCUMENTS

| | | | |
|---|---|---|---|
| CN | 106481598 | A | 3/2017 |
| CN | 106968973 | A | 7/2017 |
| CN | 109958637 | A | 7/2019 |
| CN | 209558544 | U | 10/2019 |
| CN | 111043063 | A | 4/2020 |
| CN | 111174338 | A | 5/2020 |
| CN | 210688514 | U | 6/2020 |
| CN | 111442372 | A | 7/2020 |
| CN | 111649005 | A | 9/2020 |
| CN | 213808152 | U | 7/2021 |
| CN | 213808153 | U | 7/2021 |
| CN | 213808155 | U | 7/2021 |
| CN | 213808156 | U | 7/2021 |
| CN | 213808180 | U | 7/2021 |
| CN | 213810898 | U | 7/2021 |
| JP | 2007303432 | A | 11/2007 |
| WO | WO 2020077814 | A1 | 4/2020 |

OTHER PUBLICATIONS

Midea Group Co., Ltd., Chinese Office Action, CN Patent Application No. 2022072900805560, Aug. 3, 2022, 15 pgs.
Midea Group Co., Ltd., WO, PCT/CN2021/121841, Dec. 1, 2021, 5 pgs.
Midea Group Co., Ltd., IPRP, PCT/CN2021/121841, Mar. 28, 2023, 6 pgs.
Midea Group Co., Ltd., Extended European Search Report and Supplementary Search Report, EP21876972.7, Oct. 20, 2023, 7 pgs.

* cited by examiner

FAN APPARATUS AND AIR CONDITIONER OUTDOOR UNIT

CROSS REFERENCE

The application is a continuation of PCT International Patent Application No. PCT/CN2021/121841, filed on Sep. 29, 2021, which claims priority to Chinese patent application No. 202011080566.1 filed on Oct. 10, 2020, and to Chinese patent application No. 202022248414.X filed on Oct. 10, 2020, the entire contents of which are incorporated herein by reference in its entirety.

TECHNICAL FIELD

The present application relates to the technology field of air conditioners, in particular to a fan apparatus and an air conditioner outdoor unit.

BACKGROUND

Air conditioner is a kind of a necessary daily used appliance. The function and quality of air conditioners directly affect people's daily life. At present, an axial flow fan system is usually adopted in air conditioners to provide circulating air for an outdoor unit to accelerating heat exchange. The volume of the circulating air is closely related to the performance of the outdoor unit.

In long-term research, the applicant of the present disclosure finds that a single wind wheel fan system is usually adopted in the outdoor unit of the air conditioner. In the case, an output airflow has a large amount of the rotational speed component along the circumference and the static pressure efficiency is low, leading to more noise generated while air volume increasing. Therefore, the balance of air volume and noise is difficult to keep.

SUMMARY OF THE DISCLOSURE

In some embodiments, a fan apparatus includes: a first wind wheel and a second wind wheel. The first wind wheel and the second wind wheel are spaced apart axially. A relationship among a spacing S1 between the first wind wheel and the second wind wheel is configured as: $S1<(H1+H2)/2$, where H1 is a length of the first wind wheel along the axial direction and H2 is a length of the second wheel along the axial direction.

In some embodiments, the spacing S1 of the first wind wheel and the second wind wheel satisfies: $20\ mm \leq S1 \leq 70\ mm$.

In some embodiments, the fan apparatus further includes a deflector cover, arranged on the periphery of the first wind wheel and the second wind wheel, wherein the deflector cover include a body, wherein the first wind wheel is partially arranged in the body and near an inlet side of the body; the second wind wheel is at least partially arranged in the body and near an outlet side of the body; a relationship between a spacing S2 between an inlet side of the first wind wheel and the inlet side of the body as well as the length H1 of the first wind wheel along the axial direction is configured as: $0.4<S2/H1<0.7$.

In some embodiments, a spacing S3 between an outlet side of the second wind wheel is configured as: $0<S3/H2<0.25$, and H2 is a length of the second wind wheel along the axial direction.

In some embodiments, the body part has the same diameter in the axial direction. The deflector cover includes a first tapering portion connected to the inlet side of the body and a second tapering portion connected to the outlet side of the body; a spacing S3 between the outlet of the second wind wheel and the outlet side of the body as well as a length H3 of the second tapering portion along the axial direction satisfies: $S3<H3$.

In some embodiments, a length H4 of the first tapering portion along the axial direction and an outer diameter D1 of the first wind wheel satisfy: $0.06<H4/D1<0.2$.

In some embodiments, a pressure rising distribution ratio between 0.6 to 1 is defined between the first wind wheel and the second wind wheel.

In some embodiments, the fan apparatus further includes a guide lobe spaced axially from the first wind wheel and the second wind wheel, wherein a length H5 of the guide lobe along the axial direction satisfies $0.25(H1+H2) \leq H5 \leq 0.75(H1+H2)$.

In some embodiments, the guide lobe is arranged on a side of the first wind wheel back from the second wind wheel; a distance S4 between the guide lobe and the first wind wheel along the axial direction satisfies $0.05(H1+H2) \leq S4 \leq 0.25(H1+H2)$; or the guide lobe is arranged on a side of the second wind wheel back from the first wind wheel; a distance S5 between the guide lobe and the second wind wheel along the axial direction, satisfies: $0.05(H1+H2) \leq S5 \leq 0.25(H1+H2)$.

In some embodiments, fan apparatus includes a guide lobe spaced axially from the first wind wheel and the second wind wheel, wherein a number of blades are included in the first wind wheel, the second wind wheel and the guide lobe; a number of the blades n1 in the first wind wheel, a number of the blades n2 in the second wind wheel and a number of the blades n3 in the guide lobe satisfies: $n1 \leq n2$, $n2 \leq n3 \leq 2n1$; or $n2 \leq n1, n1 \leq n3 \leq 2n2$.

In some embodiments, the guide lobe is arranged on a side of the first wind wheel opposite to the second wind wheel; the bending direction of the blades in the guide lobe is opposite to the bending direction of the blades in the first wind wheel; the side of the first wind wheel opposite to the second wind wheel is an inlet side while the side of the second wind wheel opposite to the first wind wheel is an outlet side.

In some embodiments, the guide lobe is arranged on a side of the second wind wheel opposite to the first wind wheel; the bending direction of the blades in the guide lobe is opposite to the bending direction of the blades in the second wind wheel; the side of the first wind wheel opposite to the second wind wheel is an inlet side while the side of the second wind wheel opposite to the first wind wheel is an outlet side.

In some embodiments, the number of the blades in the first wind wheel, the number of the blades in the second wind wheel and the number of the blades in the guide lobe are prime numbers of each other.

In some embodiments, the number of the blades in the guide lobe 11.

In some embodiments, the difference between the number of the blades in the first wind wheel and the number of the blades in the second wheel is 2.

In some embodiments, the diameter of the first wind wheel and the diameter of the second wind wheel are both larger than or equal to a first threshold, and the larger of the number of the blades in the first wind wheel and the number of the blades in the second wind wheel is larger than or equal to a second threshold; or the diameter of the first wind wheel and the diameter of the second wind wheel are both smaller than or equal to a first threshold, and the larger of the number of the blades in the first wind wheel and the number of the blades in the second wind wheel is smaller than or equal to a third threshold; the second threshold is larger than the third threshold.

In some embodiments, the range of the first threshold is from 450 mm to 800 mm, the second threshold is 9, and the third threshold is 7.

In some embodiments, the side of the first wind wheel back from the second wind wheel is an inlet side while the side of the second wind wheel back from the first wind wheel is an outlet side; the number of the blades in the first wind wheel is larger the number of the blades in the second wind wheel.

In some embodiments, the side of the first wind wheel opposite to the second wind wheel is an inlet side while the side of the second wind wheel opposite to the first wind wheel is an outlet side; the number of the blades n1 and the number of the blades n2 satisfy: $|hn1-sn2|\geq 2, h,s \in (1,2,3)$.

In some embodiments, the number of the blades in the first wind wheel and the number of the blades in the second wind wheel are each positively related to their respective diameters.

In some embodiments, the number of the blades in the first wind wheel and the number of the blades in the second wind wheel are each from 5 to 15.

In some embodiments, the first wind wheel rotates in a opposite direction to the second wind wheel.

In some embodiments, an air conditioner outdoor unit includes a fan apparatus and a heat exchanger. The fan apparatus adopted to guide airflow through the heat exchanger. The fan apparatus includes a first wind wheel and a second wind wheel, defined in an axial space; in which a relationship among a spacing S1 between the first wind wheel and the second wind wheel, a length H1 of the first wind wheel along the axial direction and a length H2 of the second wheel along the axial direction is configured as: $S1<(H1+H2)/2$.

In some embodiments, a first wind wheel and a second wind wheel are spaced axially apart. The spacing S1 between the first wind wheel and the second wind wheel, the length H1 of the first wind wheel in the axial direction, and the length H2 of the second wind wheel in the axial direction satisfy the following relationship: $S1<(H1+H2)/2$, may allow a better coordination relationship to be achieved between the first wind wheel and the second wind wheel, and noise may be lower when a relatively large volume of air is generated at relatively low energy consumption.

BRIEF DESCRIPTION OF THE DRAWINGS

In order to more clearly illustrate the technical solutions in the embodiments of the present disclosure, a brief description of the accompanying drawings to be used in the description of the embodiments will be given below. It will be obvious that the accompanying drawings in the following description are only some embodiments of the present disclosure, and that other accompanying drawings may be obtained on the basis of these drawings without any creative effort for those skilled in the art.

DETAILED DESCRIPTION

The technical solutions in the embodiments of the present disclosure will be clearly and completely described below with reference to the specification and drawings in the embodiments of the present disclosure. Obviously, the described embodiments are only a part of the embodiments of the present disclosure, but not all of the embodiments. Based on the embodiments in the present disclosure, all other embodiments obtained by those skilled in the art without creative efforts shall fall within the scope of the present disclosure.

The terms "first" and "second" in the present disclosure are applied for descriptive purposes only, and are not to be construed as indicating or implying relative importance or implicitly specifying the number of technical features indicated. In the description of the present disclosure, "a plurality of" and "multiple" means at least two, such as two, three, etc., unless otherwise expressly and specifically limited. In addition, the terms "include", "comprise" and "have", and any variations thereof, are intended to cover non-exclusive inclusion. For example, a process, method, system, product or apparatus including a series of steps or units is not limited to the listed steps or units, but optionally further includes steps or units that are not listed, or optionally further includes other steps or units that are inherent to the processes, methods, products or apparatus mentioned above. The term "and/or" is simply a description of the associated relationship of the associated objects, indicating that three relationships may exist, for example, A and/or B, which may mean: A alone, both A and B, and B alone. In addition, the character "/" in the present disclosure indicates that before or after the associated object is an "or" relationship.

Figure 1:
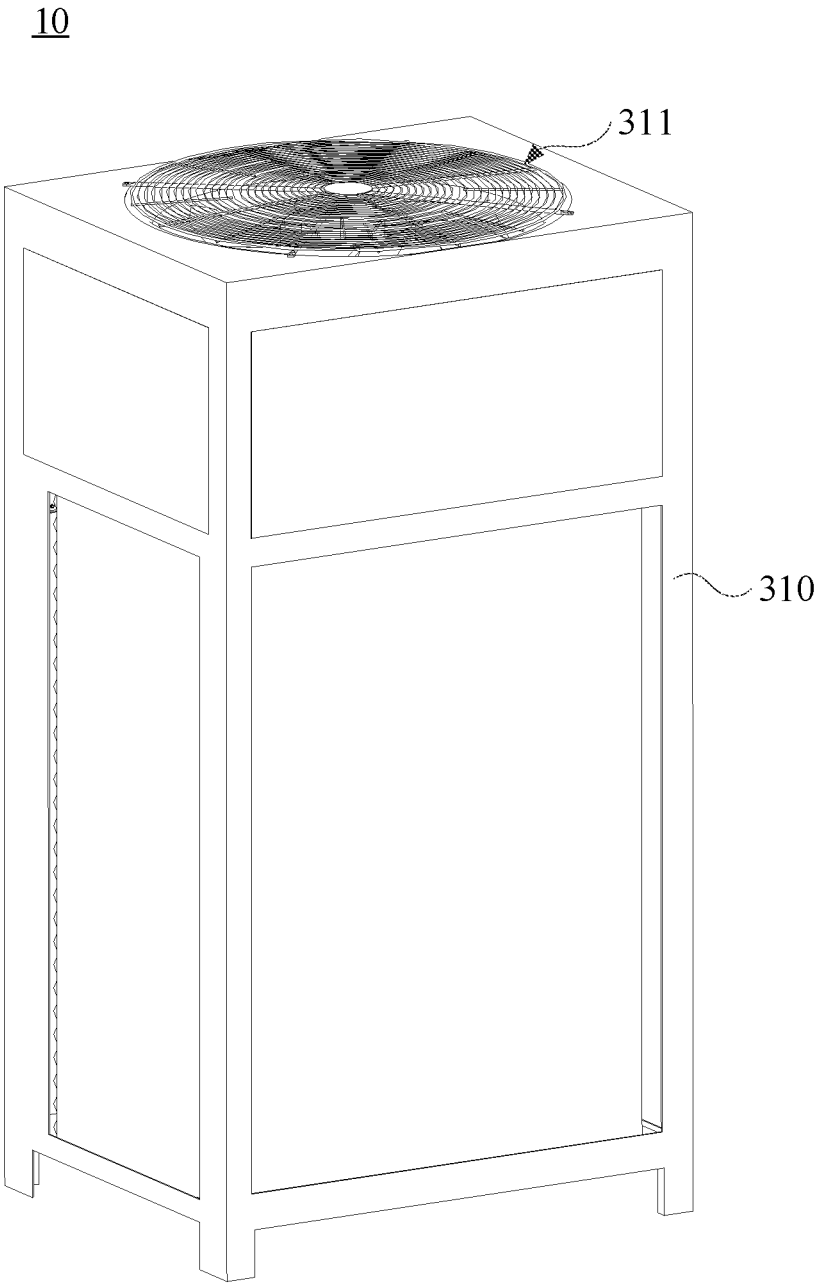
FIG. 1 is a perspective structural schematic view of an air conditioner outdoor unit according to some embodiments of the present disclosure.
Figure 2:
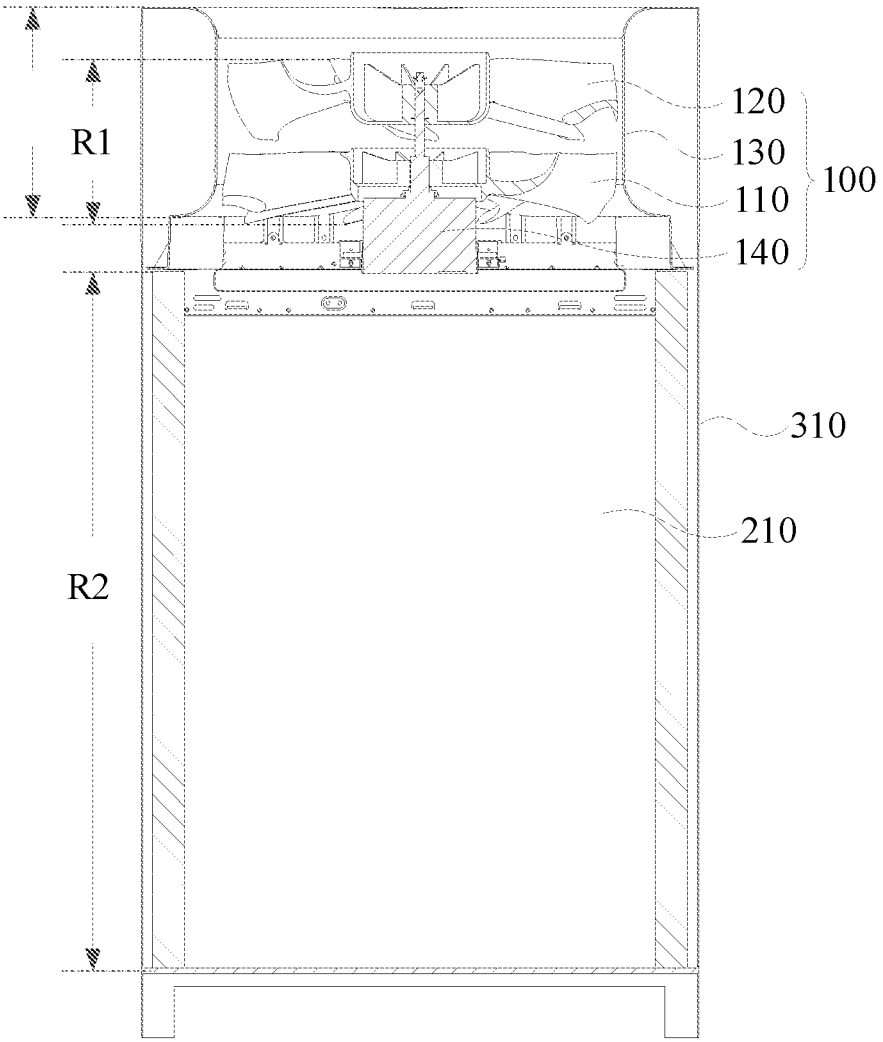
FIG. 2 is a structural cross-sectional schematic view of an air conditioner outdoor unit to some embodiments of the present disclosure.

Referring to FIGS. 1 and 2, at least two wind wheels and a heat exchanger 210 are included in an air conditioner outdoor unit 10 according to some embodiments of the present disclosure. The at least two wind wheels are axially arranged at an interval, and the heat exchanger 210 is arranged facing the at least two wind wheels. The ratio of a distance R1 between a first surface of a first wind wheel of the at least two wind wheels and a second surface of a second wind wheel of the at least two wind wheels in the axial direction and a length R2 of the heat exchanger 210 in the axial direction is from 0.1 to 0.4, such as 0.1, 0.2 or 0.4, etc. The first surface is arranged on a side of the first wind wheel back away from the second wind wheel, and the second surface is arranged on a side of the second wind wheel back away from the first wind wheel. By providing the at least two wind wheels, an air volume may be increased while keeping a noise within a preset range and a high static pressure efficiency, thereby enabling a fan efficiency to be improved. In addition, by limiting the ratio of the distance between opposite surfaces, e.g., the first and second surfaces, of the at least two wind wheels in the axial direction and the length R2 of the heat exchanger 210 in the axial direction, the air volume generated by the at least two wind wheels may match with dimensions of the heat exchanger 210 to achieve better heat transfer, silent effect and vibration dissipation.

In some embodiments, a ratio of the distance R1 between the opposite surfaces of the at least two wind wheels in the axial direction and the length R2 of the heat exchanger 210 in the axial direction is from 0.28 to 0.39, such as 0.28, 0.33 or 0.39, etc., which further enables the air volume generated by the at least two wind wheels to better match with the dimensions of the heat exchanger 210, thereby achieving better heat transfer, silent effect and vibration dissipation.

In some embodiments, a ratio of a circle area with an outer diameter of each of the at least two wind wheels to an area of an inlet side of the heat exchanger 210 is 0.089 to 0.242, such as 0.089, 0.15 or 0.242, etc. A ratio of the outer diameter of at the least two wind wheels to the area of an of the heat exchanger 210 may be $2.04\times10^{-4}$ $mm^{-1}$ to $3.63\times10^{-4}$ $mm^{-1}$, such as $2.04\times10^{-4}$ $mm^{-1}$, $3.25\times10^{-4}$ $mm^{-1}$ or $3.63\times10^{-4}$ $mm^{-1}$, etc. In this way, the air volume of an airflow generated by the at least two wind wheels may better match with a heat transfer capability of the heat exchanger 210, which enables the heat transfer efficiency of the air conditioner outdoor unit 10 to achieve a better comprehensive effect between heat transfer and energy consumption as well as noise reduction. The area of the inlet side of the heat exchanger 210 may be configured as an area of an inner surface of the heat exchanger 210.

In some embodiments, the outer diameter of the at least two wind wheels is 560 mm to 850 mm, such as 610 mm to 750 mm, specifically 560 mm, 610 mm, 700 mm, 750 mm or 850 mm, so that the air volume and air speed of the airflow generated by the at least two wind wheels may match with the heat exchanger 210 to achieve better heat transfer, silent effect and vibration dissipation.

In some embodiments, the inlet area of the heat exchanger 210 is $2.34\times10^{6}$ $mm^2$ to $2.75\times10^{6}$ $mm^2$, such as $2.34\times10^{6}$ $mm^2$, $2.5\times10^{6}$ $mm^2$ or $2.75\times10^{6}$ $mm^2$, etc., so that the heat transfer capacity of the heat exchanger 210 may match with the at least two wind wheels to achieve better heat transfer and silent effect.

In some embodiments, the air conditioner outdoor unit 10 is in the form of top air outlet, and in other embodiments, the air conditioner outdoor unit may be in the form of bottom air outlet or side air outlet, which is not limited here.

In some embodiments, the spacing S1 of two adjacent wind wheels is configured as: 20 mm≤S1≤70 mm, such as 20 mm, 50 mm or 70 mm, which may avoid too much air loss from the lower wind wheel caused by a too large spacing of at the least two wind wheels, and may further avoid interference caused by the two adjacent wind wheels, which may lead to damage the wind wheel structure, caused by a too small spacing of at least two wind wheels.

Figure 3:
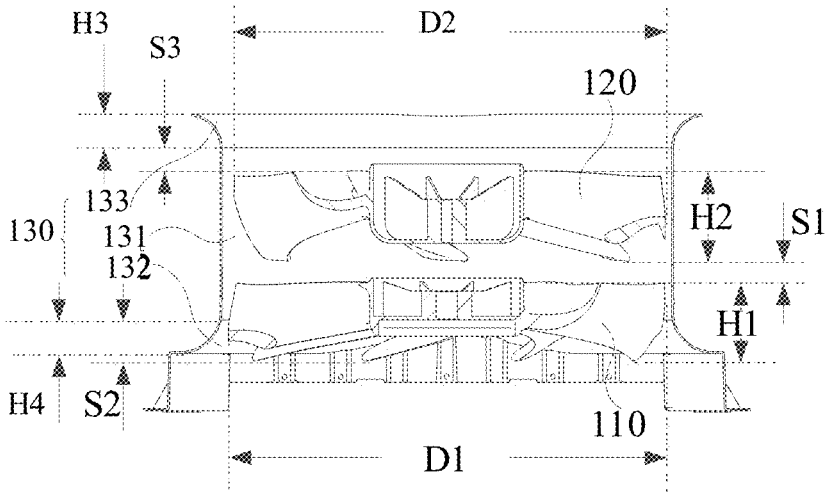
FIG. 3 is a partial structural cross-sectional schematic view of an air conditioner outdoor unit according to some embodiments of the present disclosure.

Referring to FIG. 1, FIG. 2 and FIG. 3, in some embodiments, the at least two wind wheels are arranged in a fan apparatus 100. The at least two wind wheels include a first wind wheel 110 and a second wind wheel 120, and the second wind wheel 120 is arranged on a side of the first wind wheel 110 back from the heat exchanger 210. The first wind wheel 110 and the second wind wheel 120 are arranged coaxially, which means the central axes of the two wind wheels coincide. The rotation direction of the first wind wheel 110 is opposite to the rotation direction of the second wind wheel 120, and the bending direction of blades of the first wind wheel 110 is also opposite to the bending direction of blades of the second wind wheel 120, so that the rotation direction of the airflow generated by the first wind wheel 110 is opposite to the rotation direction of the airflow generated by the second wind wheel 120 (but the flow direction of the airflow generated by the first wind wheel 110 is the same as the flow direction of the airflow generated by the second wind wheel 120). The airflow generated by the first wind wheel in the circumferential direction cancels the velocity component of the airflow generated by the second wind wheel in the circumferential direction, and the airflow generated by the second wind wheel in the circumferential direction cancels the velocity component of the airflow generated by the first wind wheel in the circumferential direction, so that the airflow flows along the axial direction of the fan apparatus 100 as much as possible, and the two wind wheels cooperate with each other to produce the airflow along the axial direction of the fan apparatus 100, which is an axial airflow.

In addition, a side of the first wind wheel 110 back from the second wind wheel 120 is an inlet side, and a side of the second wind wheel 120 back from the first wind wheel 110 is an outlet side. The airflow generated by the rotation of the first wind wheel 110 and the second wind wheel 120 passes through the first wind wheel 110 and the second wind wheel 120 in turn from the inlet side, and is then output through the outlet side.

A relationship between the outer diameter D1 of the first wind wheel 110 and the outer diameter D2 of the second wind wheel 120 is configured as: D2≥0.7D1, for example, D2=0.7D1, D2=D1 or D2=1.2D1, so that the first wind wheel 110 and the second wind wheel 120 may cooperate to produce large volume of air and generate low noise.

When D1=D2, a relationship between the length H1 of the first wind wheel 110 in the axial direction and the length H2 of the second wind wheel 120 in the axial direction is configured as: 1≤H2/H1≤1.2, for example, H2/H1=1, H2/H1=1.1, or H2/H1=1.2, etc. By configuring the length H1 of the first wind wheel 110 in the axial direction and the length H2 of the second wind wheel 120 in the axial direction to be equal, the overall air volume become greater, and the pressure difference distribution between the first wind wheel 110 and the second wind wheel 120 is also 1:1, which enables the transition of airflow from the first wind wheel 110 to the second wind wheel 120 to be smoother, leading to better noise reduction effect; by configuring the length H1 of the first wind wheel 110 in the axial direction to be less than the length H2 of the second wind wheel 120 in the axial direction, the pressure rising effect of the first wind wheel 110 may be weakened, such that the airflow may pre-spin better in the lower part of the first wind wheel 110.

In some embodiments, by arranging the length H1 of the first wind wheel 110 in the axial direction and the length H2 of the second wind wheel 120 in the axial direction, the pressure rising ratio of the first wind wheel 110 and the second wind wheel 120 may be matched. The pressure rising distribution ratio of the first wind wheel 110 to the second wind wheel 120 is 0.6 to 1, for example 0.76 to 0.84, and may be specifically 0.6, 0.76, 0.8, 0.84, or 1, etc., making the air pressure between the first wind wheel 110 and the second wind wheel 120 less influential, thus the two wind wheels may be better operated.

When D1=D2, the spacing S1 between the first wind wheel 110 and the second wind wheel 120 is configured as: 20 mm≤S1≤40 mm, for example, 26 mm≤S1≤32 mm, and may be specifically S1=20 mm, S1=26 mm, S1=30 mm, S1=32 mm or S1=40 mm, etc., which enable the first wind wheel 110 and the second wind wheel 120 to achieve a better cooperation relationship, thereby reducing the noise while producing large air volume.

By configuring the outer diameter of the first wind wheel 110 and the second wind wheel 120 to be equal, the air extraction capacities of the two wind wheels are the same, so that the two wind wheels may better match with each other and reduce the noise with large air volume generated.

In some embodiments, a relationship among the length H1 of the first wind wheel 110 in the axial direction, the length H2 of the second wind wheel 120 in the axial direction, and the spacing S1 between the first wind wheel 110 and the second wind wheel 120 is configured as: S1<(H1+H2)/2, for example, S1 may be specifically (H1+H2)/3, (H1+H2)/4 or (H1+H2)/5, etc., which enables the first wind wheel 110 and the second wind wheel 120 to achieve a better cooperation relationship, thereby producing large air volume with low energy consumption and low noise.

In some embodiments, the outdoor unit 10 may further include a deflector cover 130 arranged on a periphery of the first wind wheel 110 and the second wind wheel 120 to reduce the airflow leakage from the top of the second wind wheel 120 to achieve large air volume and lower noise at a same speed.

In some embodiments, the deflector cover 130 includes a body 131, a first tapering portion 132 connected to an inlet side of the body 131, and a second tapering portion 133 connected to an outlet side of the body 131. The body 131 is uniform with a certain diameter along the axial direction. The cross-sectional area of the first tapering portion 132 along a direction perpendicular to the axial direction gradually increases towards the heat exchanger 210, and the cross-sectional area of the second tapering portion 133 along a direction perpendicular to the axial direction gradually increases away from the heat exchanger 210 to facilitate the flow of air into and out of the deflector cover 130.

In some embodiments, the first wind wheel 110 is partially arranged in the body 131 and near the inlet side of the body 131, which facilitate the lateral inlet of the first wind wheel 110; the second wind wheel 120 is at least partially arranged in the body 131 and near the outlet side of the body 131, which enables the airflow generated by the first wind wheel 110 and the second wind wheel 120 to be channeled through the deflector cover 130.

Figure 4:
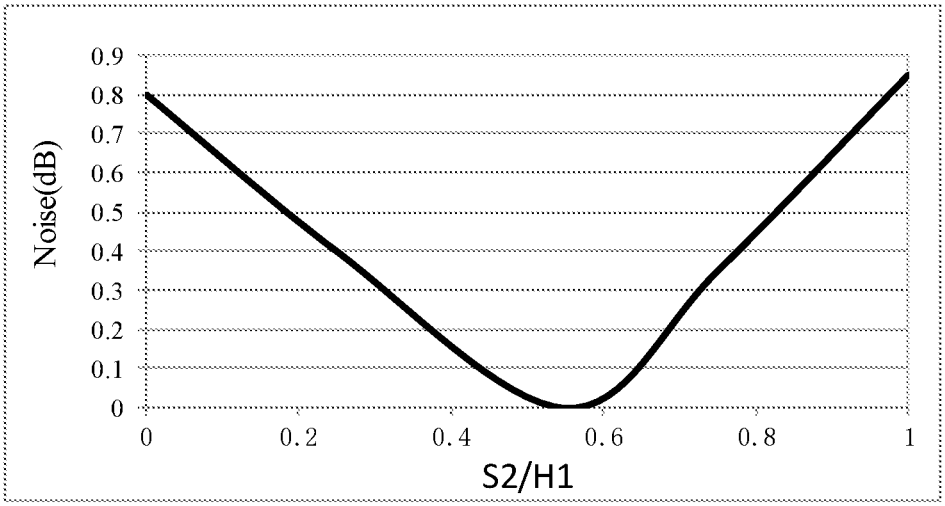
FIG. 4 is a schematic diagram of a relationship between a position of a first wind wheel in a deflector cover and a change in noise for an air conditioner outdoor unit according to some embodiments of the present disclosure.

Referring further to FIG. 4, in some embodiments, a relationship between a spacing S2 between an inlet side of the first wind wheel and the inlet side of the body as well as the length H1 of the first wind wheel along the axial direction is configured as: $0.4<S2/H1<0.7$, for example $0.57<S2/H1<0.62$, specifically S2/H1 may be specifically 0.45, 0.5, 0.58, 0.6 or 0.65, etc., leading to the input air of the deflector cover 130 more smooth, with greater air volume and less noise. In this case, the inlet side of the body 131 is connected to the first tapering portion 132 (the lower end of the cylindrical section in FIG. 3), and the outlet side of the body 131 is connected to the second tapering portion 133 (the upper end of the cylindrical section in FIG. 3).

Figure 5:
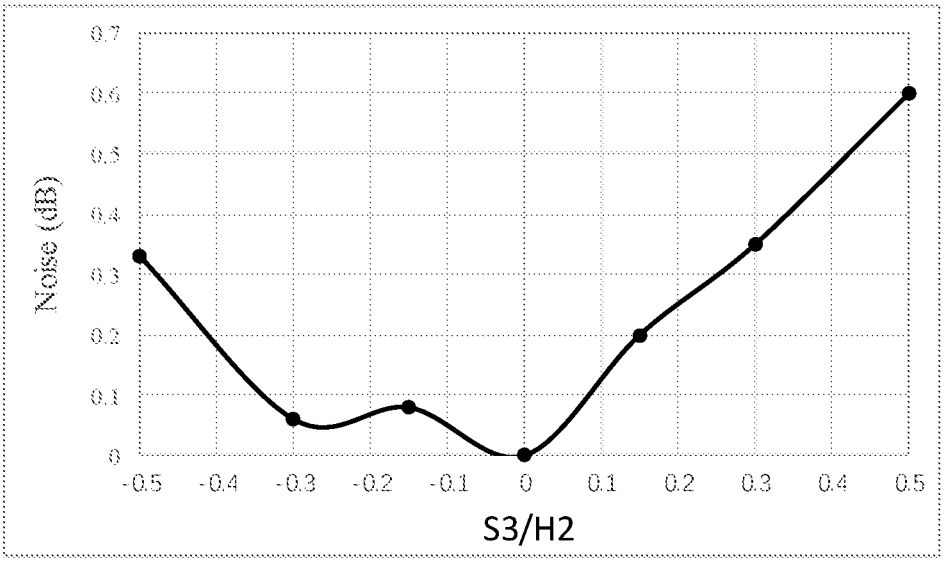
FIG. 5 is a schematic diagram of a relationship between ae position of a second wind wheel in the deflector cover and a change in noise for an air conditioner outdoor unit according to some embodiments of the present disclosure.
Figure 6:
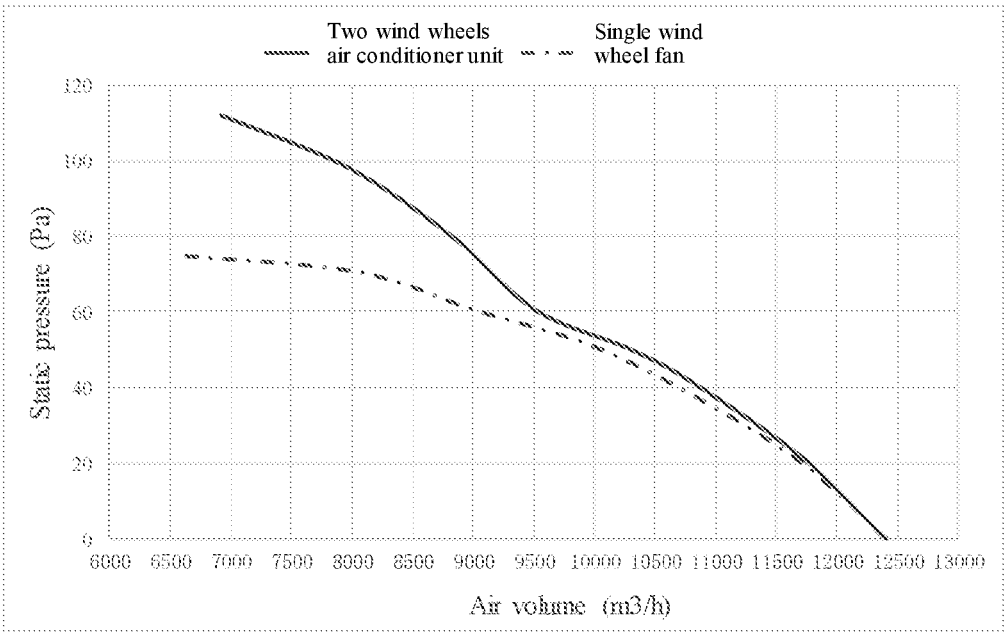
FIG. 6 is a schematic diagram of a relationship between an air volume and a change of static pressure in a single wind wheel fan and an outdoor unit with at least two wind wheels according to some embodiments of the present disclosure.
Figure 7:
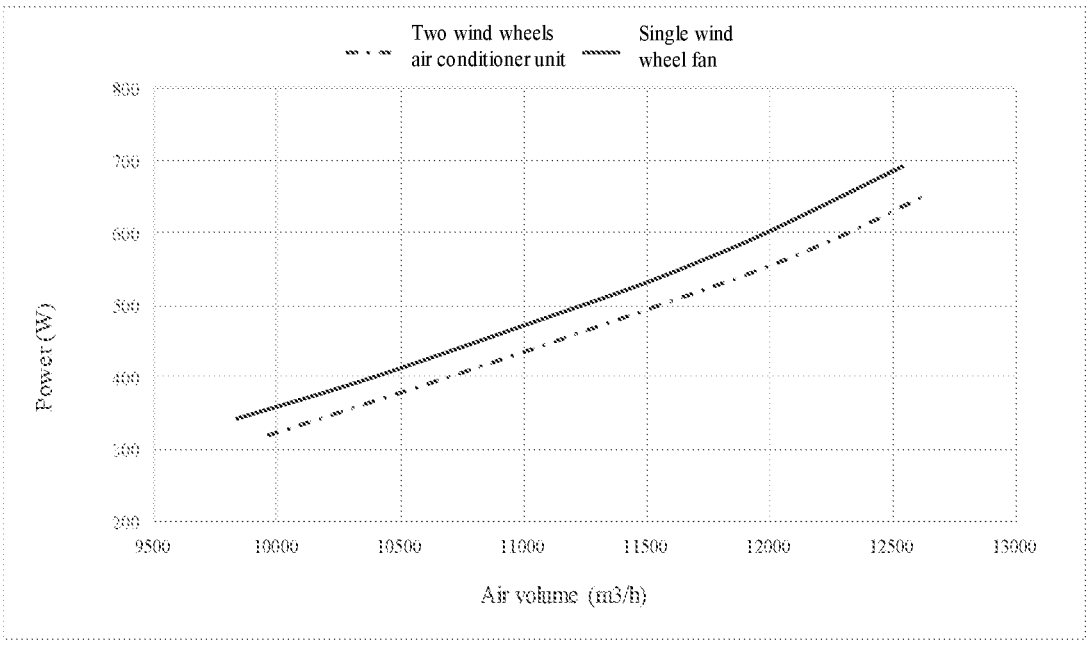
FIG. 7 is a schematic diagram, of a relationship between an air volume and a change of power in a single wind wheel fan and an air outdoor unit with two wind wheels according to some embodiments of the present disclosure.
Figure 8:
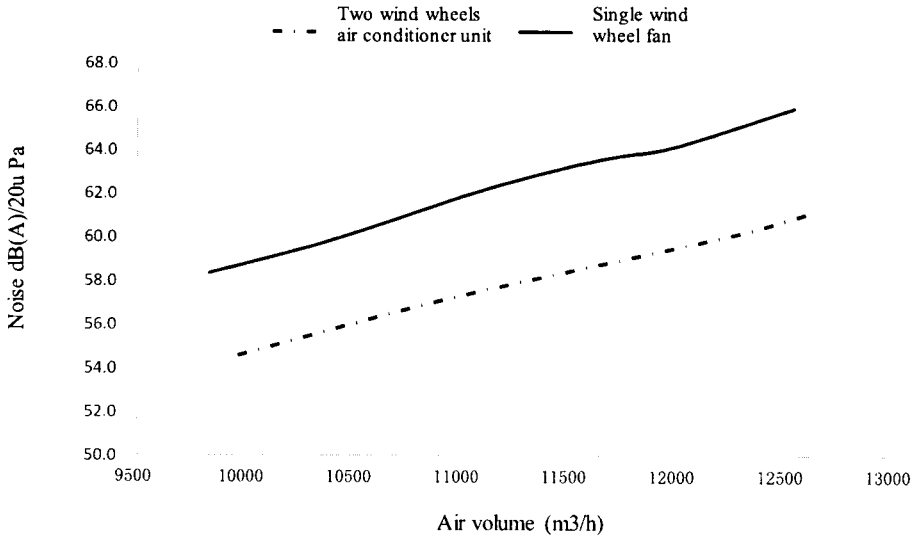
FIG. 8 is a schematic diagram of a relationship between an air volume and a change of noise in a single wind wheel fan and an air outdoor unit some embodiments with two wind wheels according to some embodiments of the present disclosure.

Referring further to FIG. 5, in some embodiments, the spacing S3 between the outlet side of the second wind wheel 120 and the outlet side of the body 131 is configured as positive when the air outlet side of the second wind wheel 120 is arranged above the air outlet side of the body 131; the spacing S3 between the air outlet side of the second wind wheel 120 and the air outlet side of the body 131 is configured as negative when the air outlet side of the second wind wheel 120 is arranged below the air outlet side of the body 131. A relationship between the spacing S3 between the outlet side of the second wind wheel 120 and the outlet side of the body 131 as well as the length H2 of the second wind wheel 120 along the axial direction is configured as: $0<|S3/H2|<0.25$, such as, 0.1, 0.15 or 0.2, etc., so that the deflector cover 130 may achieve a better effect on airflow guidance for the airflow generated by the first wind wheel 110 and the second wind wheel 120 and produce low noise.

In some embodiments, a relationship between a spacing S3 between the side of the second wind wheel 120 back from the heat exchanger 210 and the side of the body 131 back from the heat exchanger 210, and the length H3 of the second tapering portion 133 in the axial direction is configured as: $S3<H3$, so that the first wind wheel 110 and the second wind wheel 120 may achieve a better effect on airflow output and generate large air volume with less noise.

In some embodiments, a relationship between the length H4 of the first tapering portion 132 in the axial direction and the outer diameter D1 of the first wind wheel 110 is configured as: $0.06<H4/D1<0.2$, for example, H4/D1 may be specifically 0.08, 0.1 or 0.15, so that the first wind wheel 110 may achieve a better effect on airflow input and generate large air volume with low noise.

In some embodiments, a relationship between the distance R1 between the inlet side of the second wind wheel 120 and the outlet side of the first wind wheel 110 in the axial direction and the length R3 of the deflector cover 130 in the axial direction is configured as: $0.7<R1/R3<0.95$, for example, R1/R3 may be specifically 0.75, 0.8 or 0.9, etc., so that the deflector cover 130 may achieve a better effect on airflow guidance for the airflow generated by the first wind wheel 110 and the second wind wheel 120 and a higher efficiency of the first wind wheel 110 and the second wind wheel 120, which is conductive to increasing the air volume and reducing the noise at the same time.

In some embodiments, the pressure rising distribution ratio between the first wind wheel 110 and the second wind wheel 120 is 0.6 to 1, for example, 0.76 to 0.84, and can be specifically 0.6, 0.76, 0.8, 0.84 or 1, etc., which enables the air pressure between the first wind wheel 110 and the second wind wheel 120 to be less influential, thus the two wind wheels may operate better.

In some embodiments, the air conditioner outdoor unit 10 further includes a drive component 140 configured to drive the first wind wheel 110 and the second wind wheel 120 to rotate in opposite directions with a small wind speed and radial velocity at the outlet side, which is conducive to output air. In addition, air reversion is less likely to occur, and the air conditioner outdoor unit has strong pressure resistance, which may solve the problem of high pressure drop outside the unit during the installation of a multi-connected air conditioner outdoor unit.

In other embodiments, the first wind wheel 110 and the second wind wheel 120 may be driven by two drive components to rotate respectively, without limitation herein.

Referring to Table 1, assuming that a diameter of the first wind wheel 110 and the second wind wheel 120 is 700 mm, compared with a single wind wheel fan, the air conditioner outdoor unit including two wind wheels in the present disclosure reaches the same air volume with less speed and power, which may reduce the hardware requirements of the drive component and reduce the noise value as well as improve the sound quality.

TABLE 1

| | Single wind wheel fan | Two wind wheels outdoor unit in the present disclosure |
|---|---|---|
| Diameter (mm) | 700 | 700 |
| Rotational speed (rpm) | 920 | 460 |
| Air volume (m3/h) | 12000 | 12000 |
| Power (W) | 604 | 561 |
| Noise (dB) | 64.2 | 59.6 |

Referring to FIGS. 6 to 9, compared with the single wind wheel fan, the air conditioner outdoor unit with two wind wheels in the present disclosure has a greater static pressure, transports a greater distance of air, requires less power, and generates less noise, when the same preset air volume is achieved. In addition, with the same rotational frequency, the noise generated is lower.

Figure 10:
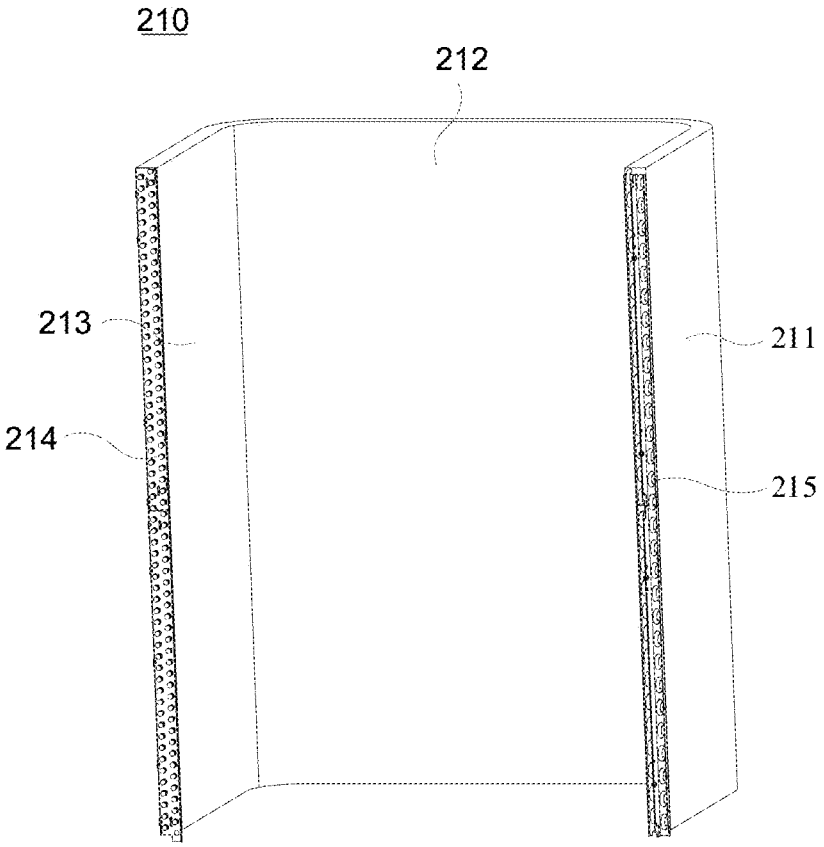
FIG. 10 is a t perspective structural schematic view of a heat exchanger of an air conditioner outdoor unit according to some embodiments of the present disclosure.
Figure 11:
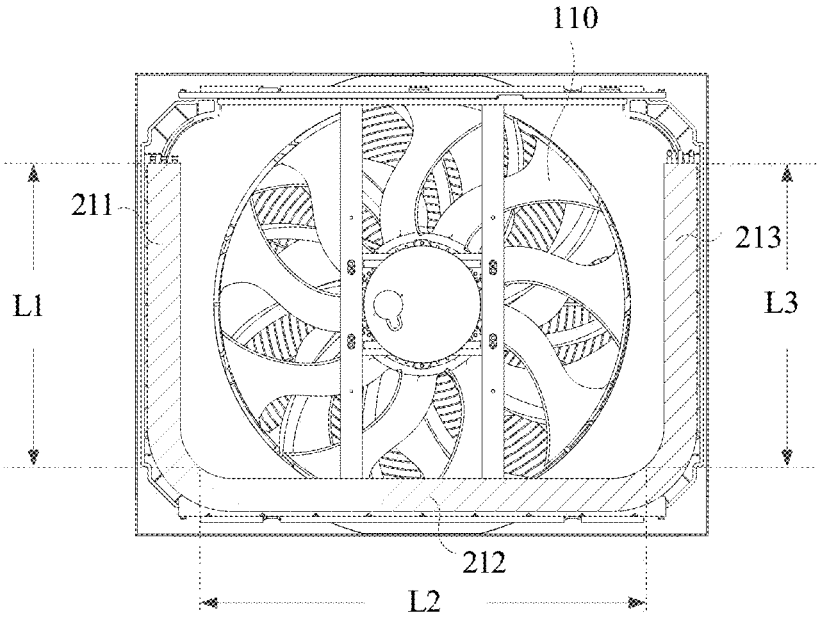
FIG. 11 is an elevated structural schematic view of a heat exchanger of an outdoor unit o according to some embodiments of the present disclosure.

Referring together to FIGS. 10 and 11, in some embodiments, the heat exchanger 210 is a U-shaped heat exchanger, and the heat exchanger 210 is formed with a first inlet surface 211, a second inlet surface 212, and a third inlet surface 213. The length L1 is arranged in the axial vertical direction on the first inlet surface 211 and in the extension direction of the first inlet surface 211. The length L2 is defined in the axial vertical direction on the second inlet surface 212 and in the extension direction of the second inlet surface. The length L3 is defined in the vertical direction of the axial direction on the third inlet surface 213 and in the extension direction of the third inlet surface 213. A relationship among the outer diameter D1 of the first wind wheel, the length L1 on the first inlet surface, the length L2 on the second inlet surface, and the length L3 on the third inlet surface is configured as: $0.85D1<L1<L2<1.5D1$, $0.85D1<L3<L2<1.5D1$, so that each air inlet surface of the heat exchanger 210 achieves a better effect on airflow input, thereby improving the heat transfer efficiency, and thus being able to cooperate with the first wind wheel 110 and the second wind wheel 120 to achieve a better noise reduction effect.

In some embodiments, the heat exchanger 210 includes multiple fins 214 spaced apart and multiple rows of heat exchanger tubes 215 arranged through the multiple fins 214. The multiple fins 214 may be formed with curved louvers (not shown in the figures). The number of rows of the heat exchanger tubes 210 is 2 to 3, for example 2, 2.5 (2 rows on one side and 3 rows on the other side) or 3. The tube diameter of heat exchanger tubes 215 is 5 mm to 9.5 mm, such as 6.2 mm to 7.3 mm, specifically 5 mm, 6 mm, 6.2 mm, 7.3 mm or 9.5 mm. The spacing of each two adjacent fins 214 is 1.3 mm to 1.6 mm, such as 1.34 mm to 1.48 mm, specifically 1.3 mm, 1.34 mm, 1.4 mm, 1.48 mm or 1.6 mm. In this case, the heat exchanger 210 may achieve better heat transfer, thus to cooperate with the first wind wheel 110 and the second wind wheel 120 to achieve better noise reduction.

In some embodiments, the tube diameter of the heat exchanger tube 215 is inversely related to the outer diameter of each two adjacent wind wheels. In addition, the heat transfer area is configured as the outer surface area of the heat exchanger tube 215 and the fins 214. Since the greater the tube diameter of the heat exchanger tube 215, the greater the heat transfer area of the heat exchanger 210, thereby configuring the tube diameter of the heat exchanger tube 215 in an inverse relationship with the outer diameter of each two adjacent wind wheels may keep a balance between the heat transfer area and the air volume to maintain a certain heat transfer efficiency.

In some embodiments, the number of rows of the heat exchanger tubes 215 is inversely related to the outer diameter of each two adjacent wind wheels. Since the more rows of heat exchanger tubes 215, the greater the heat transfer area of the heat exchanger 210, thereby configuring the number of rows of the heat exchanger tubes 215 in an inverse relationship with the outer diameter of each two adjacent wind wheels may keep a balance between the heat transfer area and the air volume to maintain a certain heat transfer efficiency.

In some embodiments, the spacing of two adjacent fins in multiple fins 214 is inversely related to the outer diameter of each two adjacent wind wheels. Since the greater the spacing of each two adjacent fins in multiple fins 214, the faster the heat transfer of fins 214, thereby configuring the spacing of each two adjacent fins in multiple fins 214 in an inverse relationship with the outer diameter of each two adjacent wind wheels may keep a balance between the heat transfer area and the air volume to maintain a certain heat transfer efficiency.

Figure 12:
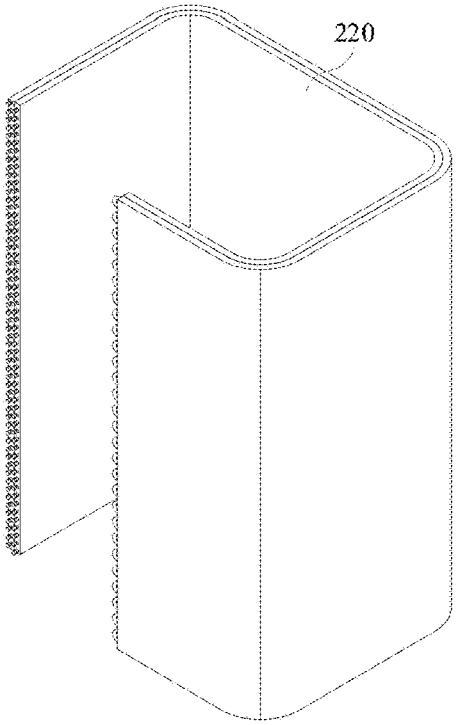
FIG. 12 is a perspective structural schematic view of a heat exchanger of an air conditioner outdoor unit according to other embodiments of the present disclosure.
Figure 13:
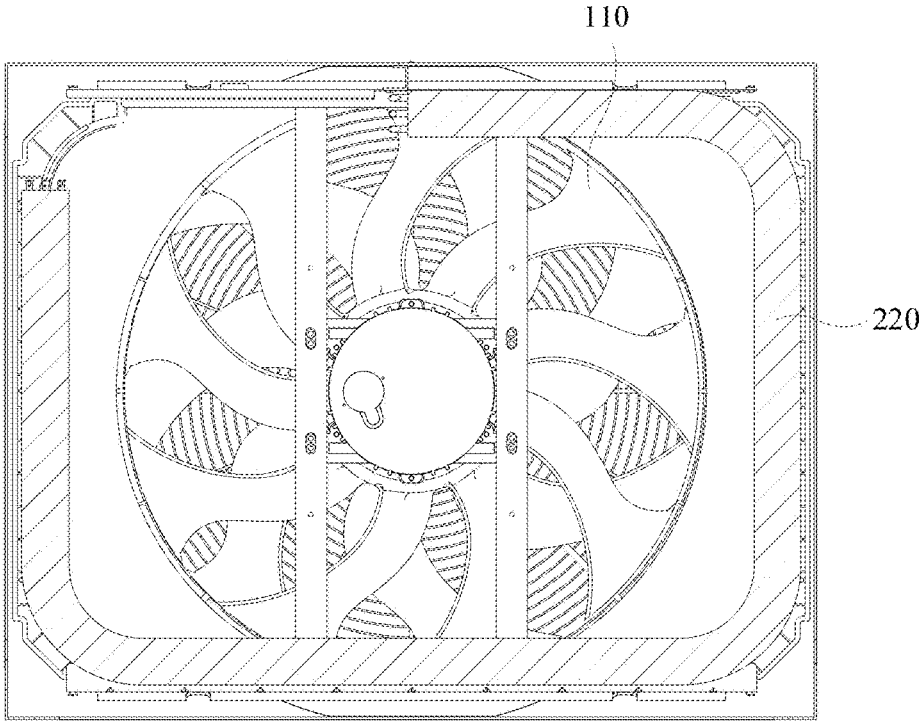
FIG. 13 is an elevated structural schematic view of a heat exchanger of an air conditioner outdoor unit according to other embodiments of the present disclosure.
Figure 14:
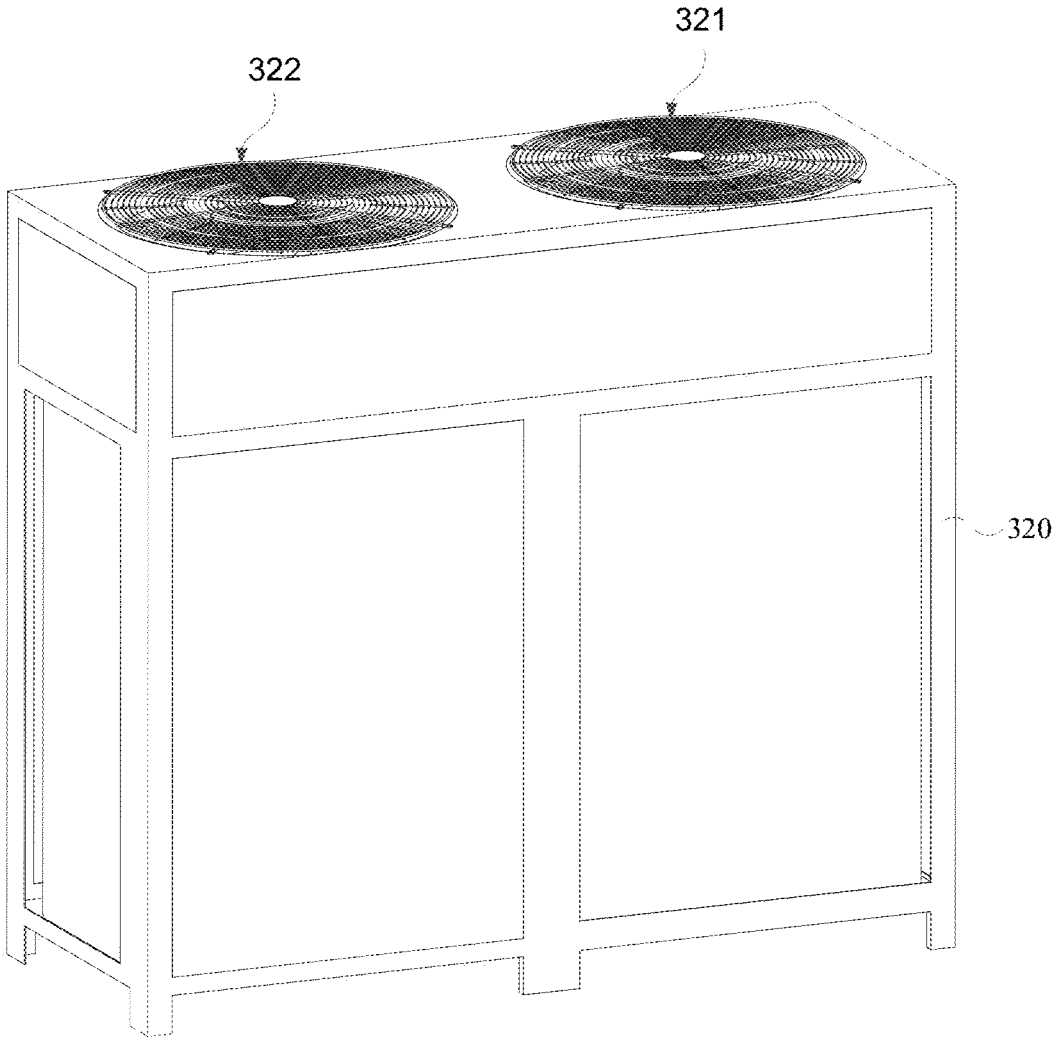
FIG. 14 is a perspective structural schematic view of an air conditioner outdoor unit according to other embodiments of the present disclosure.
Figure 15:
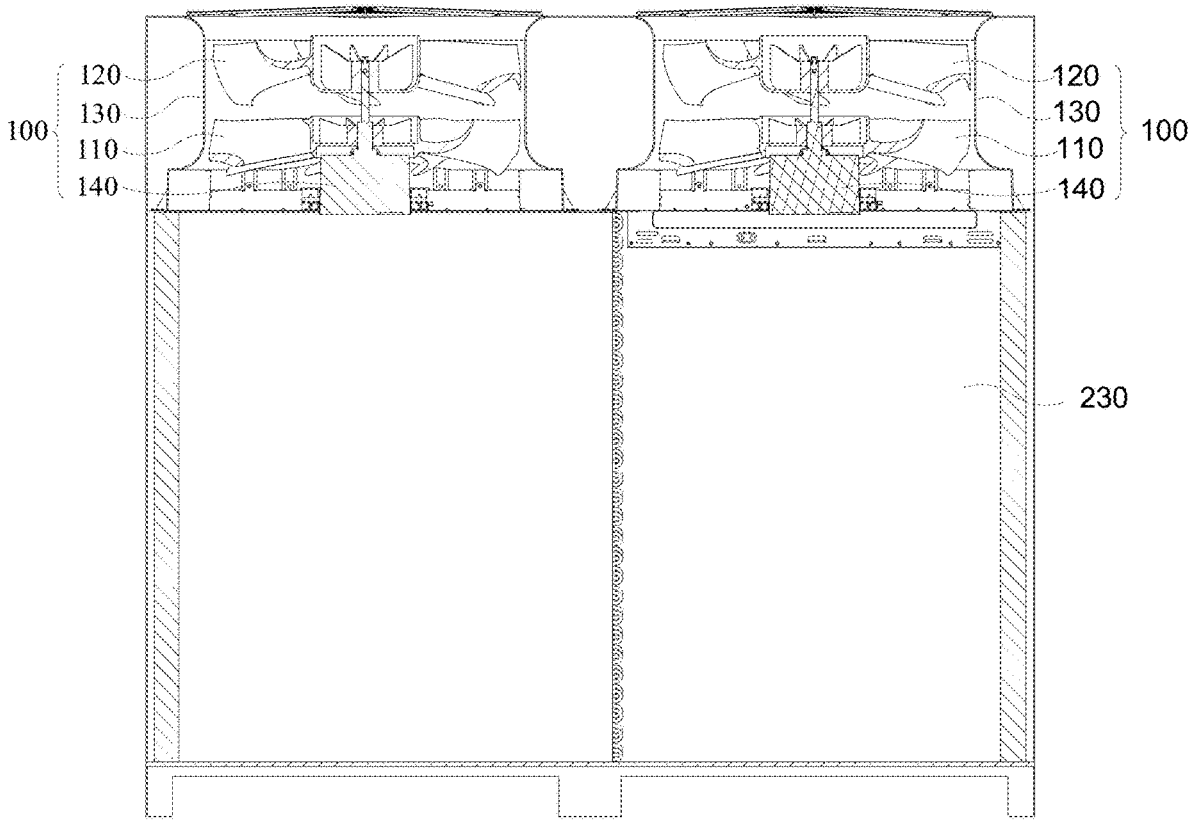
FIG. 15 is a structural cross-sectional schematic view of an air conditioner outdoor unit according to other embodiments of the present disclosure.
Figure 16:
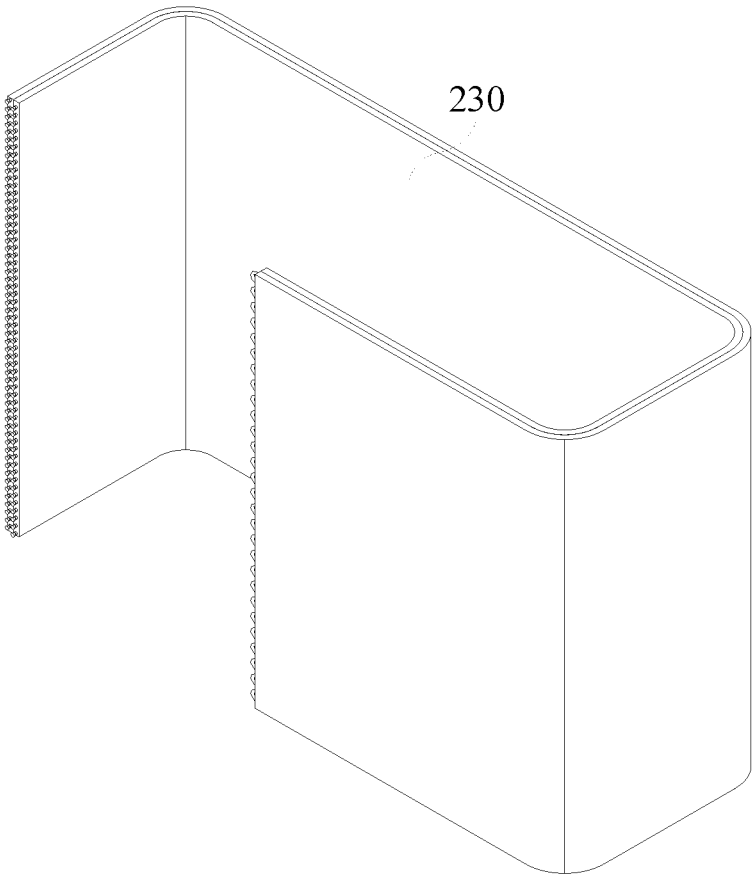
FIG. 16 is a perspective structural schematic view of a heat exchanger of an air conditioner outdoor unit according to other embodiments of the present disclosure.

Referring to FIGS. 12 and 13, in other embodiment, the heat exchanger 220 may be a G-shaped heat exchanger, where the heat exchanger 220 is formed with four air inlet surfaces, and a gap in one of the four air inlet surfaces, such that the one air inlet surface is disconnected to its adjacent air inlet two sets of heat surface. The G shaped heat exchanger has a larger area of the air inlet surface leading to better heater transfer.

In other embodiments, the heat exchanger may be an I-shaped heat exchanger, a V-shaped heat exchanger, or a square-shaped heat exchanger, without limitation herein.

Referring to FIGS. 14 to 17, in other embodiments of the present disclosure, the air conditioner outdoor unit 10 includes two sets of fan apparatuses 100, a heat exchanger 230, and a housing 320. The two sets of fan apparatus 100 and the heat exchanger 230 are arranged in the housing 320, each set of fan apparatus 100 includes a first wind wheel 110, a second wind wheel 120, a deflector cover 130, and a drive component 140. Air outlets 321 and 322 are defined on the housing 320. For the structures of the first wind wheel 110, the second wind wheel 120, the deflector cover 130 and the drive components 140, references may be made in the embodiments above, which will not be repeated here. By arranging the two sets of fan apparatus 100 in the air conditioner outdoor unit 10, the air volume and air pressure may be increased, thereby improving fan efficiency. Further, since the low-frequency sound quality of the fan apparatus 100 with two wind wheels in the present disclosure is better than that of an existing fan apparatus with a single wind wheel, the application of the two sets of fan apparatus 100 may avoid the low-frequency beat vibration noise generated by the coupling of blades of two single wind wheels.

In some embodiments, the heat exchanger 230 is a G-shaped heat exchanger facing the two sets of fan apparatus 100. The ratio of the area of a circle, in which the outer diameter of the first wind wheel 110 or the second wind wheel 120 is located, to the area of the inlet surface of the heat exchanger 230 is 0.052 to 0.089, such as 0.052, 0.06 or 0.089, etc. The ratio of the area of the at least two wind wheels to the inlet surface of the heat exchanger 210 may be specifically $1.18\times10^{-4}$ $mm^{-1}$ to $2.04\times10^{-4}$ $mm^{31\ 1}$, such as $1.18\times10^{-4}$ $mm^{-1}$, $1.76\times10^{-4}$ $mm^{-1}$ or $2.04\times10^{-4}$ $mm^{-1}$, etc., which enables the air volume of the airflow generated by the at least two wind wheels to cooperate better with the heat transfer capacity of the heat exchanger 230, thereby improving the heat transfer efficiency and reducing the noise as well as the energy consumption.

In some embodiments, the area of inlet surface of the heat exchanger 230 is $2.75\times10^{6}$ $mm^2$ to $4.76\times10^{6}$ $mm^2$, such as $2.75\times10^{6}$ $mm^2$, $3\times10^{6}$ $mm^2$ or $4.76\times10^{6}$ $mm^2$, etc., enabling the heat transfer capacity of the heat exchanger 230 to cooperate with the first wind wheel 110 and the second wind wheel 120 to achieve better heat transfer and silent effect.

In some embodiments, the area of inlet surface of the heat exchanger 230 is 1.5 times to 2 times the area of inlet surface of the heat exchanger 210 or the heat exchanger 220 in the above embodiments, such as 1.74 times to 1.87 times, specifically 1.5 times, 1.74 times, 1.8 times, 1.87 times or 2 times.

Figure 17:
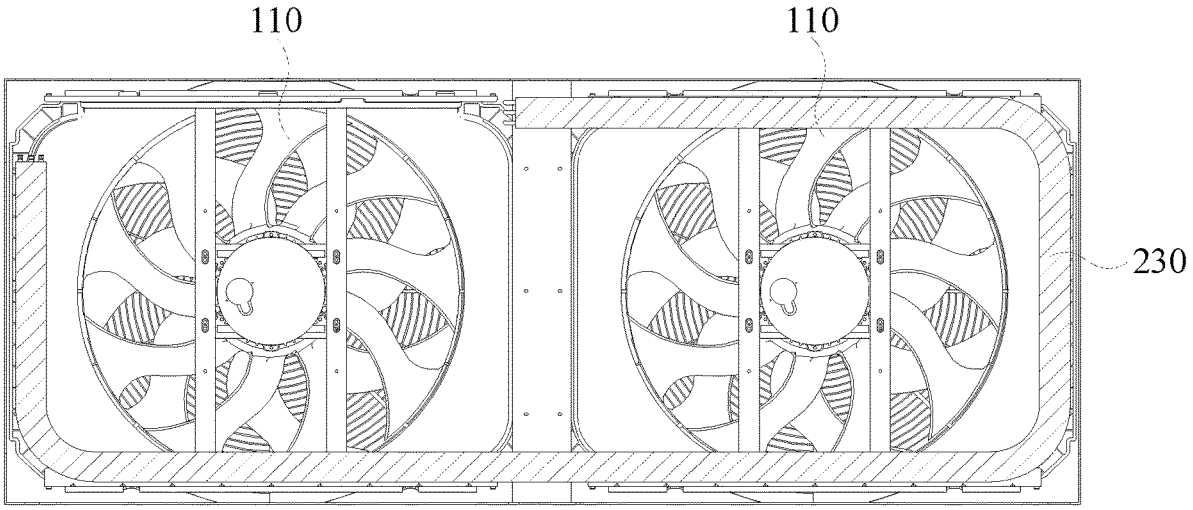
FIG. 17 is an elevated structural schematic view of a heat exchanger of an air conditioner outdoor unit according to other embodiments of the present disclosure.

In some embodiments, the dimensions of the two sets of fan apparatus 100 may be the same or different, for example, the dimensions of the fan apparatus 100 facing three inlet surfaces of the heat exchanger 230 on the right side shown in FIG. 17 may be larger than the dimensions of the fan apparatus 100 facing two inlet surfaces of the heat exchanger 230 on the left side, so that the air extraction capacity of the fan apparatus 100 and the heat transfer capacity of the corresponding part of the heat exchanger 230 are matched, thereby improving the heat transfer efficiency and reducing the noise and the energy consumption.

In some embodiments, the two sets of fan apparatus 100 are arranged on a same level to match the heat exchanger 230 with a large area on the inlet side. In other embodiments, the two sets of fan apparatus 100 may further be arranged coaxially, which may further increase the air pressure and be suitable for special occasions with high static pressure requirements.

Figure 18:
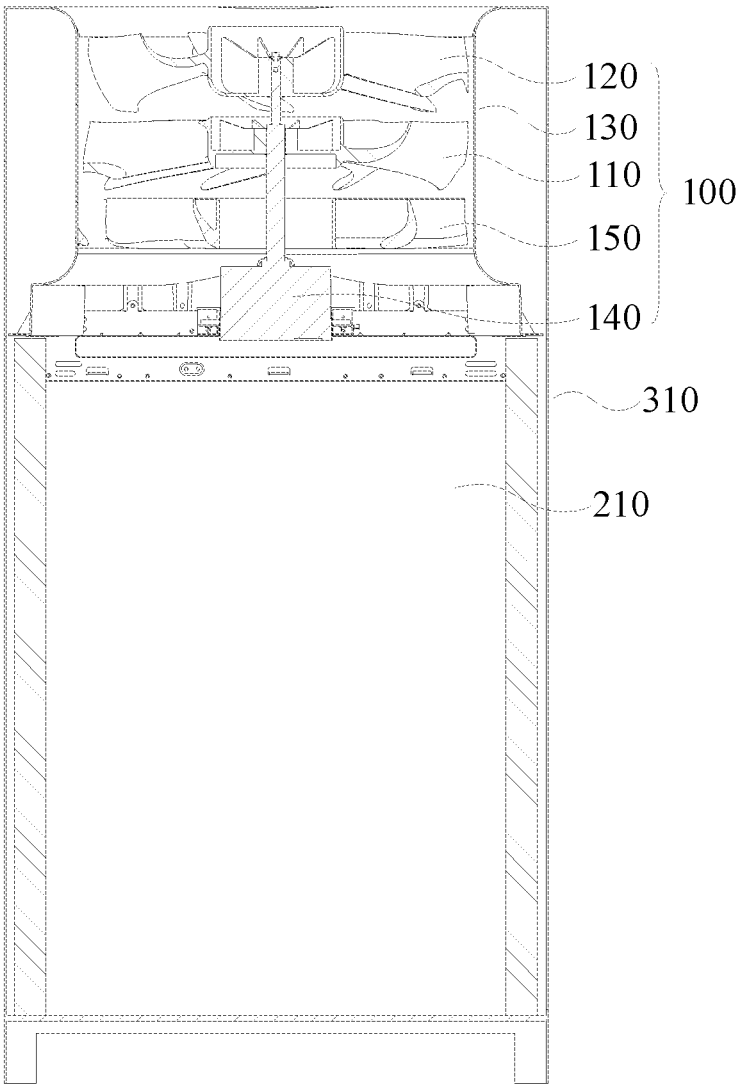
FIG. 18 is a structural cross-sectional schematic view of an air conditioner outdoor unit according to other embodiments of the present disclosure.
Figure 19:
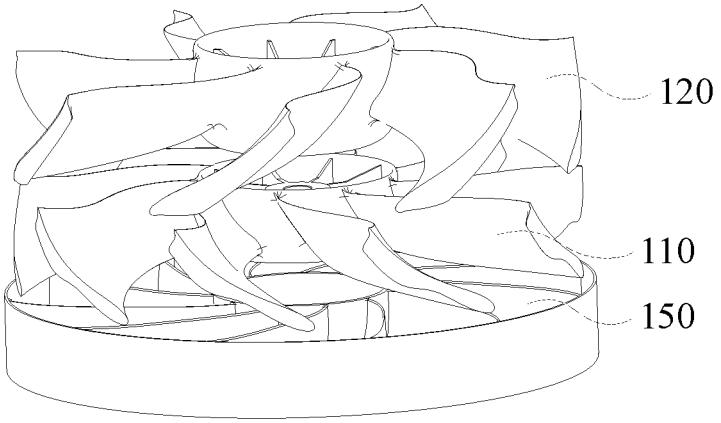
FIG. 19 is a perspective schematic view of a partial structure of an air conditioner outdoor unit according to other embodiments of the present disclosure.
Figure 20:
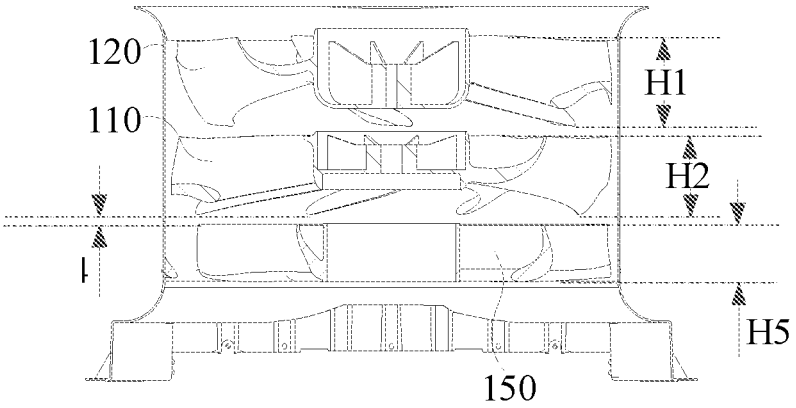
FIG. 20 is a cross-sectional schematic view of a partial structure of an air conditioner outdoor unit according to other embodiments of the present disclosure.

Referring to FIGS. 18 to 20, in other embodiments of the present disclosure, the air conditioner outdoor unit 10 includes a first wind wheel 110, a second wind wheel 120, and a guide lobe 150. The first wind wheel 110, the second wind wheel 120, and the guide lobe 150 are arranged axially apart with each other. The structures of the first wind wheel 110 and the second wind wheel 120 are mentioned in the above embodiments of the air conditioner outdoor unit 10, and will not be repeated here.

In some embodiments, a relationship among a length H5 of the guide lobe 150 along the axial direction, the length H1 of the first wind wheel 110 along the axial direction, and the length H2 of the second wind wheel 120 along the axial direction is configured as: $0.25(H1+H2)\leq H5\leq 0.75(H1+H2)$, for example, $0.48(H1+H2)\leq H5\leq 0.62(H1+H2)$, which may be specifically H5=0.25(H1+H2), H5=0.48(H1+H2), H5=0.5(H1+H2), H5=0.25(H1+H2) or H5=0.75(H1+H2), thereby enabling the guide lobe 150 to match with the first wind wheel 110 and the second wind wheel 120 to achieve a better effect on airflow guidance, and thus achieve a better heat exchange effect, silent effect and vibration dissipation effect.

In some embodiments, the guide lobe 150 is arranged on a side of the first wind wheel 110 back from the second wind wheel 120, providing a pre-spin effect to rectify a complex airflow, which may reduce the energy loss of the airflow and improve the air volume.

In some embodiments, a relationship among a distance S4 between the guide lobe 150 and the first wind wheel 110 along the axial direction, the length H1 of the first wind wheel 110 along the axial direction, and the length H2 of the second wind wheel 120 along the axial direction is configured as: 0.05(H1+H2)≤S4≤0.25(H1+H2), for example, 0.11(H1+H2)≤S4≤0.19(H1+H2), which may be specifically S4=0.05(H1+H2), S4=0.11(H1+H2), S4=0.15(H1+H2), S4=0.19(H1+H2), or S4=0.25(H1+H2), which may avoid poor flow guidance caused by the distance between the guide lobe 150 and the first wind wheel 110 from being too far away, or avoid interference damaging the structure of the guide lobe 150 or the first wind wheel 110 caused by the distance between the guide lobe 150 and the first wind wheel 110 from being too close.

Figure 21:
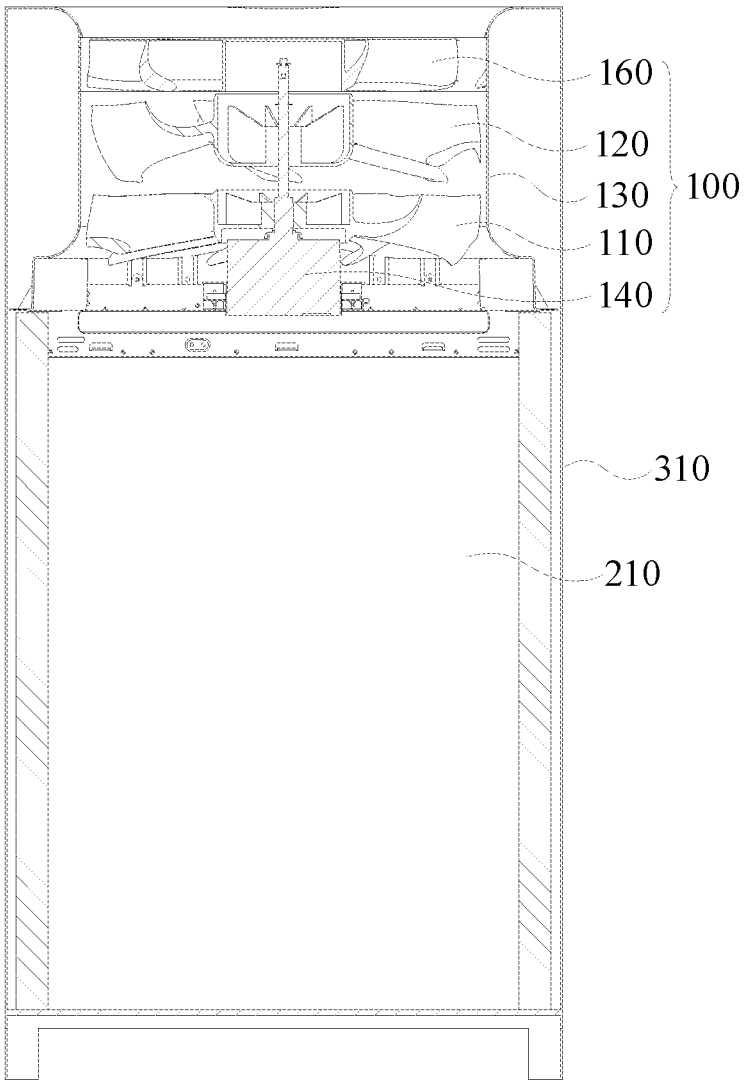
FIG. 21 is a structural cross-sectional schematic view of an air conditioner outdoor unit according to other embodiments of the present disclosure.
Figure 22:
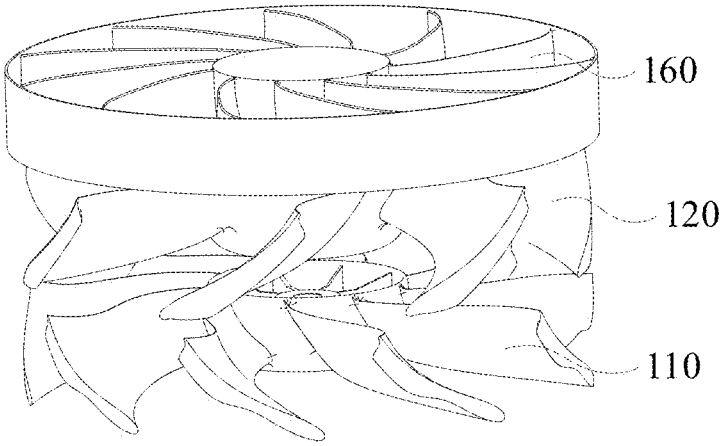
FIG. 22 is a perspective schematic view of a partial structure of an air conditioner outdoor unit according to other embodiments of the present disclosure.
Figure 23:
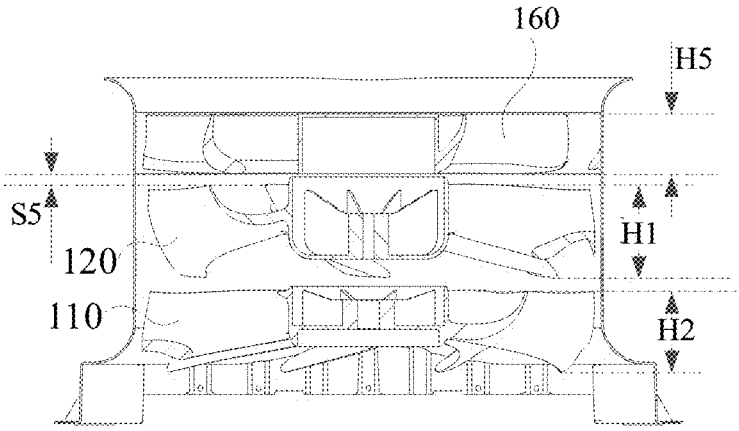
FIG. 23 is a cross-sectional schematic view of a partial structure of an air conditioner outdoor unit according to other embodiments of the present disclosure.
Figure 24:
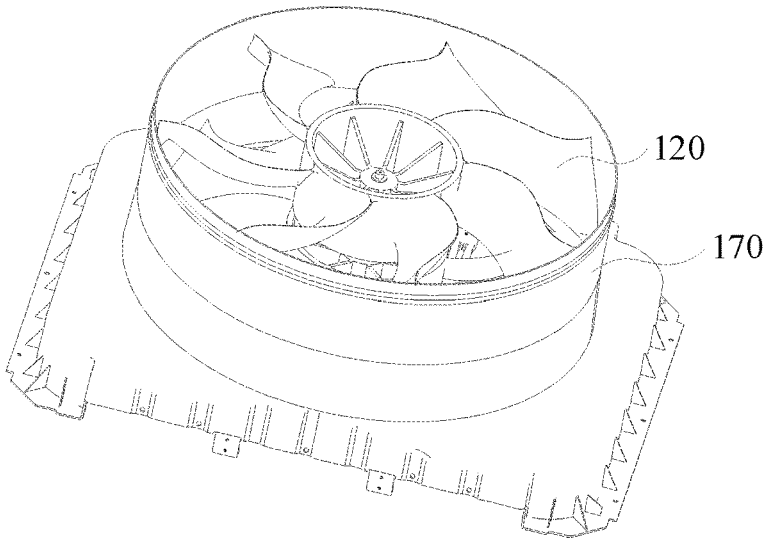
FIG. 24 is a perspective schematic view of a partial structure of an air conditioner outdoor unit according to other embodiments of the present disclosure.
Figure 25:
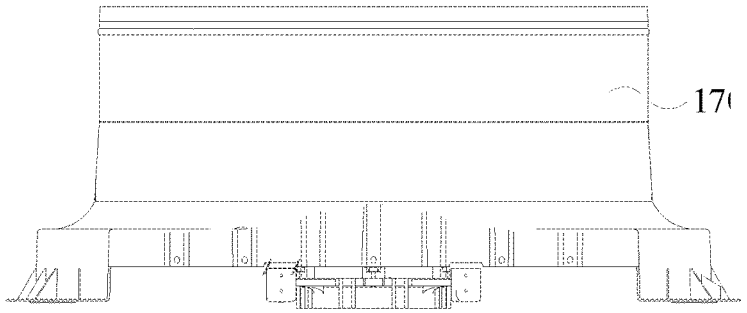
FIG. 25 is a front schematic view of a partial structure of an air conditioner outdoor unit according to other embodiments of the present disclosure.
Figure 26:
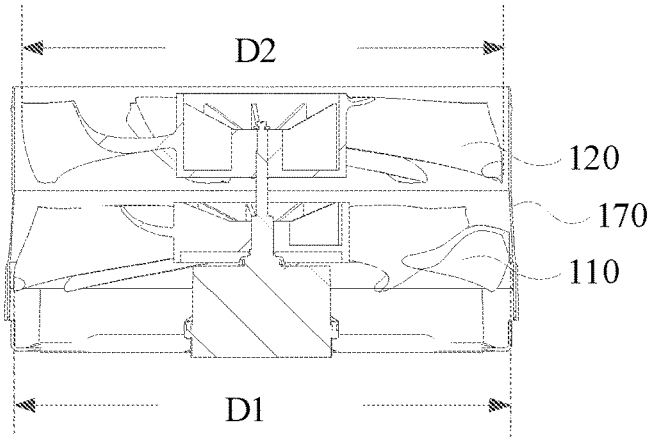
FIG. 26 is a cross-sectional schematic view of a partial structure of an air conditioner outdoor unit according to other embodiments of the present disclosure.
Figure 27:
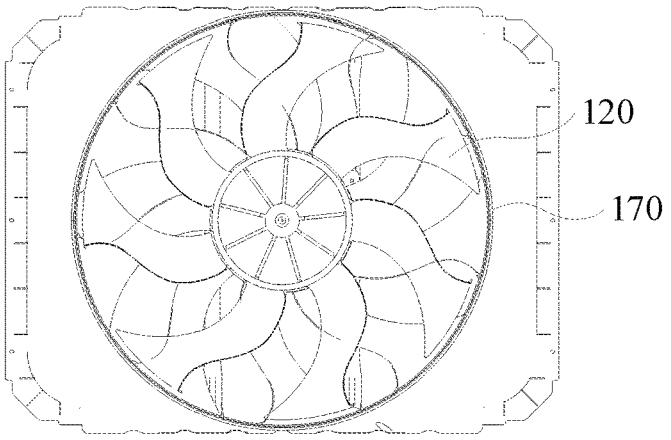
FIG. 27 is a top schematic view of a partial structure of an air conditioner outdoor unit according to other embodiments of the present disclosure.
Figure 28:
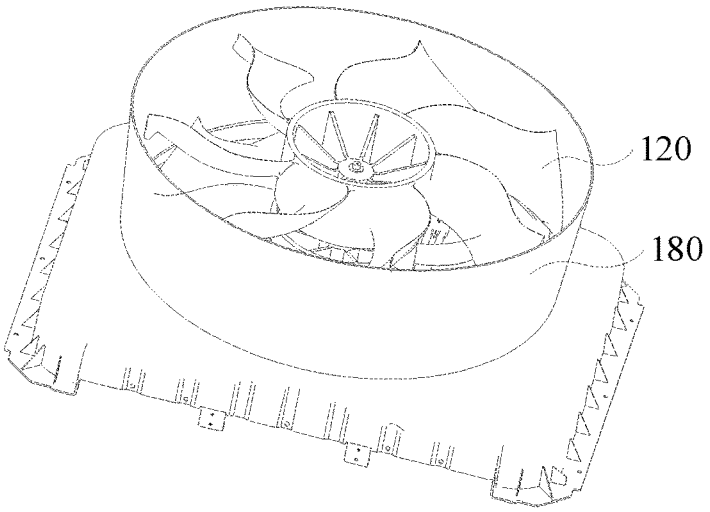
FIG. 28 is a perspective schematic view of a partial structure of an air conditioner outdoor unit according to other embodiments of the present disclosure.
Figure 29:
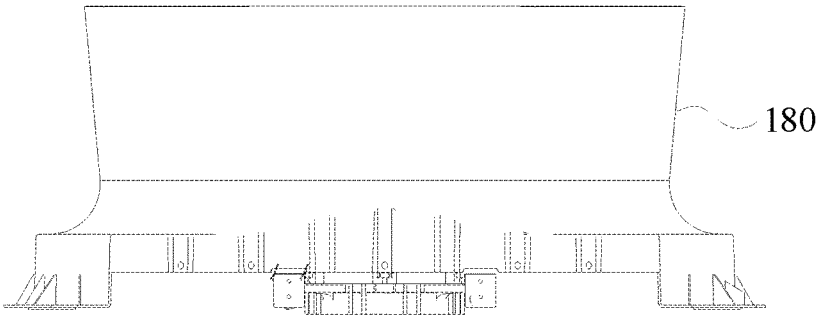
FIG. 29 is a front schematic view of a partial structure of an air conditioner outdoor unit according to other embodiments of the present disclosure.
Figure 30:
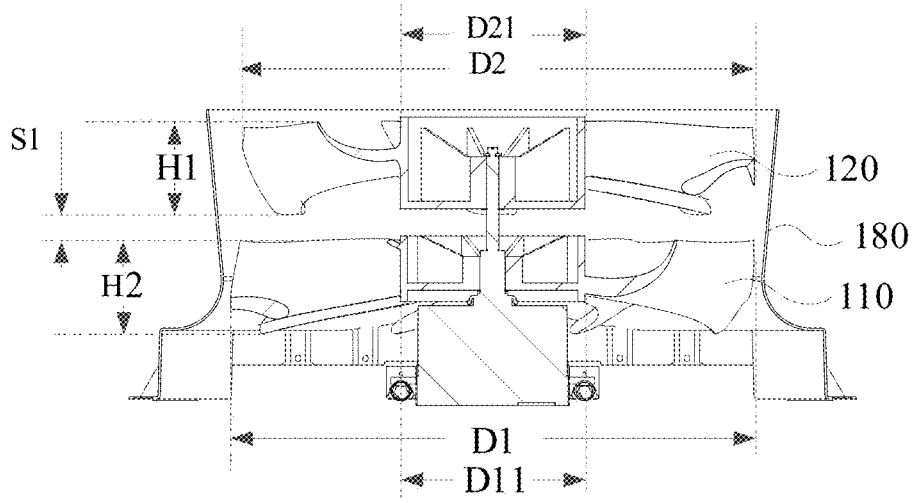
FIG. 30 is a cross-sectional schematic view of a partial structure of an air conditioner outdoor unit according to other embodiments of the present disclosure.
Figure 31:
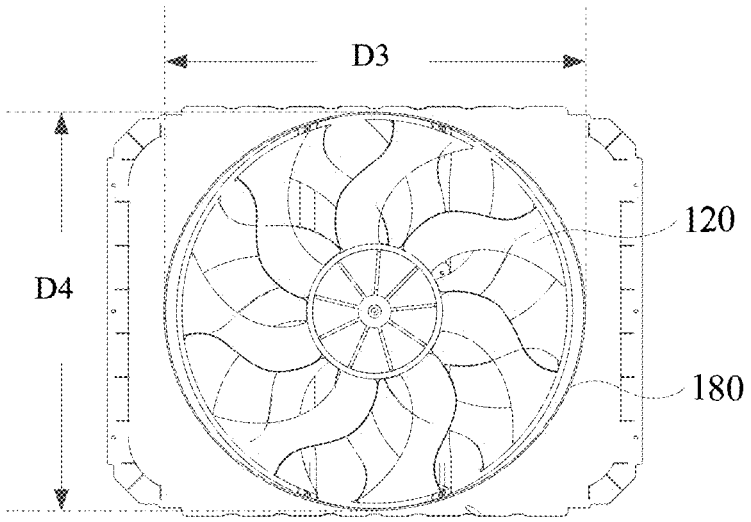
FIG. 31 is a top schematic view of a partial structure of an air conditioner outdoor unit according to other embodiments of the present disclosure.

Referring to FIGS. 21 to 23, in other embodiments, the guide lobe 160 may be arranged on a side of the second wind wheel 120 back from the first wind wheel 110. The second wind wheel 120 recovers the rotational velocity component of the airflow on the outlet side of the first wind wheel 110 in the circumferential direction by rotating in the opposite direction to the first wind wheel 110. The rotational velocity component of the airflow on the outlet side of the second wind wheel 120 is further recovered by the guide lobe 160, so that the airflow may flow out in the axial direction, thereby recovering the dynamic pressure and improving the static pressure, and thus improving the overall air volume and fan efficiency.

In some embodiments, a relationship among a distance S5 between the guide lobe 160 and the second wind wheel 120 along the axial direction, the length H1 of the first wind wheel 110 along the axial direction, and the length H2 of the second wind wheel 120 along the axial direction is configured as: 0.05(H1+H2)≤S5≤0.25(H1+H2), for example, 0.11(H1+H2)≤S5≤0.19(H1+H2), which can be specifically S5=0.05(H1+H2), S5=0.11(H1+H2), S5=0.15(H1+H2), S5=0.19(H1+H2) or S5=0.25(H1+H2), which may avoid poor flow guidance caused by the distance between the guide lobe 150 and the second wind wheel 120 from being too far away, or avoid interference damaging the structure of the guide lobe 150 or the second wind wheel 120 caused by the distance between the guide lobe 150 and the second wind wheel 120 from being too close.

Referring to FIGS. 24 to 27, in other embodiments of the present disclosure, the air conditioner outdoor unit 10 includes a first wind wheel 110, a second wind wheel 120, and a deflector cover 170. The structures of the first wind wheel 110 and the second wind wheel 120 are mentioned in above embodiments of the air conditioner outdoor unit 10, and will not be repeated here.

In some embodiments, the deflector cover 170 is configured as a cylindrical shape. A relationship among the outer diameter D1 of the first wind wheel 110, the outer diameter D2 of the second wind wheel 120, the length H1 of the first wind wheel 110 in the axial direction, and the length H2 of the second wind wheel 120 in the axial direction is configured as: 1.01≤D1/D2≤1.03, 1≤H2/H1≤1.15, such as D1/D2=1.01, D1/D2=1.02 or D1/D2=1.03, etc., and H2/H1=1, H2/H1=1.1 or H2/H1=1.15, etc. Since a blade tip of the wind wheel is a main source of noise, and an outer side of the blade tip of the second wind wheel 120 generates vortex, by configuring the outer diameter of the first wind wheel 110 to be greater than the outer diameter of the second wind wheel 120, the airflow from the outer circumference of the first wind wheel 110 may blow away the vortex at the blade tip of the second wind wheel 120, thereby making a better effect on noise reduction and cooperatively achieving better heat exchange effect with the heat exchanger 210.

Referring to FIGS. 28 to 31, in other embodiments of the present disclosure, the air conditioner outdoor unit includes a first wind wheel 110, a second wind wheel 120 and a deflector cover 180. The structures of the first wind wheel 110 and the second wind wheel 120 are mentioned in the above embodiments of the air conditioner outdoor unit 10, and will not be repeated here.

In some embodiments, a cross-section of a top of the deflector cover 180 along a direction perpendicular to the axial direction is elliptical, which may transform at least a part of the dynamic pressure of the airflow at the top of the deflector cover 180 into static pressure, thereby increasing the pressure difference between the first wind wheel 110 and the second wind wheel 120, and thus improving the overall air volume and reducing the energy consumption and the noise.

In some embodiments, a relationship between the outer diameter D1 of the first wind wheel 110 and the long axis D3 of the deflector cover 180 is configured as: 1.04≤D3/D1≤1.1, such as D3/D1=1.04, D3/D1=1.08 or D3/D1=1.1, etc., so that the deflector cover 180 may better guide the airflow generated by the first wind wheel 110 and the second wind wheel 120, thus achieving a better heat transfer effect, silent effect and vibration dissipation effect.

In some embodiments, a relationship between the outer diameter D1 of the first wind wheel 110 and the long axis D3 of the deflector cover 180 is configured as: 1.06≤D3/D1≤1.08, such as, D3/D1=1.06, D3/D1=1.07 or D3/D1=1.08, etc., so that the deflector cover 180 may better guide the airflow generated by the first wind wheel 110 and the second wind wheel 120, thus achieving a better heat transfer effect, silent effect and vibration dissipation effect.

In some embodiments, a relationship between the outer diameter D1 of the first wind wheel 110 and the short axis D4 of the deflector cover 180 is configured as: 1.02≤D4/D1≤1.05, such as D4/D1=1.02, D4/D1=1.03 or D4/D1=1.05, etc., so that the deflector cover 180 may better guide the airflow generated by the first wind wheel 110 and the second wind wheel 120, thus achieving a better heat transfer effect, silent effect and vibration dissipation effect.

In some embodiments, a relationship between the outer diameter D1 of the first wind wheel 110, and the outer diameter D2 of the second wind wheel 120 is configured as: D2≥0.7D1, for example, D2=0.7D1, D2=D1, or D2=1.2D1, enabling the first wind wheel 110 to cooperate with the second wind wheel to produce large air volume and generate low noise.

In some embodiments, the outer diameter D1 of the first wind wheel is configured as: 560 mm≤D1≤850 mm, for example, 630 mm≤D1≤710 mm, which can be specifically 560 mm, 630 mm, 700 mm, 710 mm or 850 mm, so that the air volume and the air speed of the airflow generated by the first wind wheel 110 may keep balance and achieve a better heat exchange effect, silent effect and vibration dissipation effect.

In some embodiments, a relationship between the outer diameter D1 of the first wind wheel 110 and a hub diameter D11 of the first wind wheel 110 is configured as: $2 \leq D1/D11 \leq 4.5$, for example, $3.3 \leq D1/D11 \leq 4.1$, specifically D1/D11=2, D1/D11=3, D1/D11=3.3, D1/D11=4.1 or D1/D11=4.5, etc., so that the structure of the first wind wheel 110 may achieve a better matching effect with the deflector cover 180.

In some embodiments, a relationship between the outer diameter D2 of the second wind wheel 120 and a hub diameter D21 of the second wind wheel 120 is configured as: $2 \leq D2/D21 \leq 4.5$, for example, $3.4 \leq D2/D21 \leq 4.2$, specifically D2/D21=2, D2/D21=3, D2/D21=3.4, D2/D21=4.2 or D2/D21=4.5, etc., so that the structure of the first wind wheel 120 may achieve a better matching effect with the deflector cover 180.

In some embodiments, a relationship among the length H1 of the first wind wheel 110 in the axial direction, the length H2 of the second wind wheel 120 in the axial direction, and the spacing S1 between the first wind wheel 110 and the second wind wheel 120 is configured as: $S1<(H1+H2)/2$, for example, S1 can be specifically (H1+H2)/3, (H1+H2)/4 or (H1+H2)/5, etc., which may enable the first wind wheel 110 and the second wind wheel 120 to achieve a better coordination with each other, thereby generating large air volume while low noise.

In some embodiments, the pressure rising distribution ratio between the first wind wheel 110 and the second wind wheel 120 is 0.6 to 1, for example 0.76 to 0.84, and may be specifically 0.6, 0.76, 0.8, 0.84 or 1, etc., which reduce the influence of air pressure between the first wind wheel 110 and the second wind wheel 120, thereby enabling better operation.

Referring further to FIG. 2, the following is an example of the above embodiments of the fan apparatus 100 including the first wind wheel 110 and the second wind wheel 120.

In some embodiments, the number of blades of the first wind wheel 110 and the number of blades of the second wind wheel 120 are prime numbers of each other. In this case, the beat vibration noise generated by the operation of the first wind wheel 110 and the second wind wheel 120 may be reduced, and some of the harmonic noise may be reduced or eliminated to facilitate further noise reduction.

Figure 9:
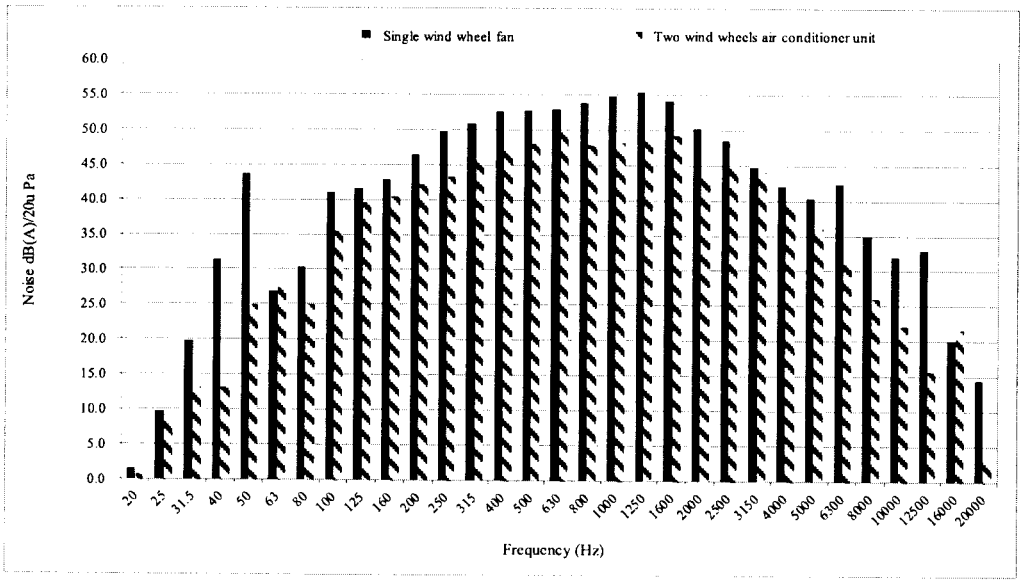
FIG. 9 is a schematic diagram of the relationship between the frequency and the change of noise in a single wind wheel fan and an air conditioner outdoor unit included by two wind wheels according to some embodiments of the present disclosure.

Referring together to FIG. 9, which illustrates the comparison of the noise volume at different frequencies between the outdoor unit with two wind wheel of the present disclosure and a conventional single wind wheel fan. According to the schematic diagram, with the same frequency, the fan apparatus 100 in the present disclosure has less noise. This is due to the fact that the airflow passing through the conventional single wind wheel fan will produce significant noise. In comparison, in the fan apparatus 100 in the present disclosure, the number of blades of the first wind wheel 110 and the number of blades of the second wind wheel 120 are reasonably matched, thereby effectively reducing the noise.

In some embodiments, the difference between the number of blades of the first wind wheel 110 and the number of blades of the second wind wheel 120 is 2. Specifically, a relationship between the number n1 of blades of the first wind wheel 110 and the number n2 of blades of the second wind wheel 120 is configured as: $n1>n2$, $n1=n2+2$, or $n1<n2$, $n2=n1+2$.

According to an analysis of a basic theory of pneumatic noise and practical engineering experience, when the number of blades of two adjacent wind wheels (i.e., the first wind wheel 110 and the second wind wheel 120) connected in series axially satisfies the above relationship, the noise generated by mutual interference between the two wind wheels is low, which is conducive to reducing the pneumatic noise of the fan apparatus 100.

In particular, the noise produced by the tail flow action of the first wind wheel 110 on a leading edge (near the edge of the first wind wheel 110) of the second wind wheel 120 causes the noise produced by the second wind wheel 120 to be greater than the noise produced by the first wind wheel 110. The above design ensures that the number of blades of the second wind wheel 120 is less than that of the first wind wheel 110, which is conducive to reducing the noise produced by the second wind wheel 120, thereby facilitating to reducing the overall noise of the fan apparatus 100.

In addition, when the diameter of the first wind wheel 110 (as shown in D1 in FIG. 3, which is the same below) and the diameter of the second wind wheel 120 (as shown in D2 in FIG. 3, which is the same below) are both greater than or equal to a first threshold, the greater between the number of blades of the first wind wheel 110 and the number of blades of the second wind wheel 120 is greater than or equal to a second threshold; or when the diameter of the first wind wheel 110 and the diameter of the second wind wheel 120 are both less than the first threshold, the greater of the number of blades of the first wind wheel 110 and the number of blades of the second wind wheel 120 is less than or equal to a third threshold. In addition, the second threshold is greater than the third threshold.

For example, the first threshold is taken in the range of 450 mm to 800 mm, in some embodiment 600 mm, etc.; the second threshold is preferably 9, etc.; and the third threshold is preferably 7, etc. Specifically, when the diameter of the first wind wheel 110 and the diameter of the second wind wheel 120 are both greater than or equal to 600 mm, n1=9, n2=7 or n1=7, n2=9, etc.; and when the diameter of the first wind wheel 110 and the diameter of the second wind wheel 120 are both less than 600 mm, n1=7, n2=5 or n1=5, n2=7, etc.

Based on the method above, the following two problems may be solved: in a first case where the diameter of the first wind wheel 110 and the diameter of the second wind wheel 120 are small while the number of blades of the first wind wheel 110 and the number of blades of the second wind wheel 120 are large, the thickening of the first wind wheel 110 and the second wind wheel 120 is so large that the performance of the first wind wheel 110 and the second wind wheel 120 is decreased; in a second case where the diameter of the first wind wheel 110 and the diameter of the second wind wheel 120 are large while the number of blades of the first wind wheel 110 and the number of blades of the second wind wheel 120 are small, the performance of the first wind wheel 110 and the second wind wheel 120 may not be fully utilized.

Figure 32:
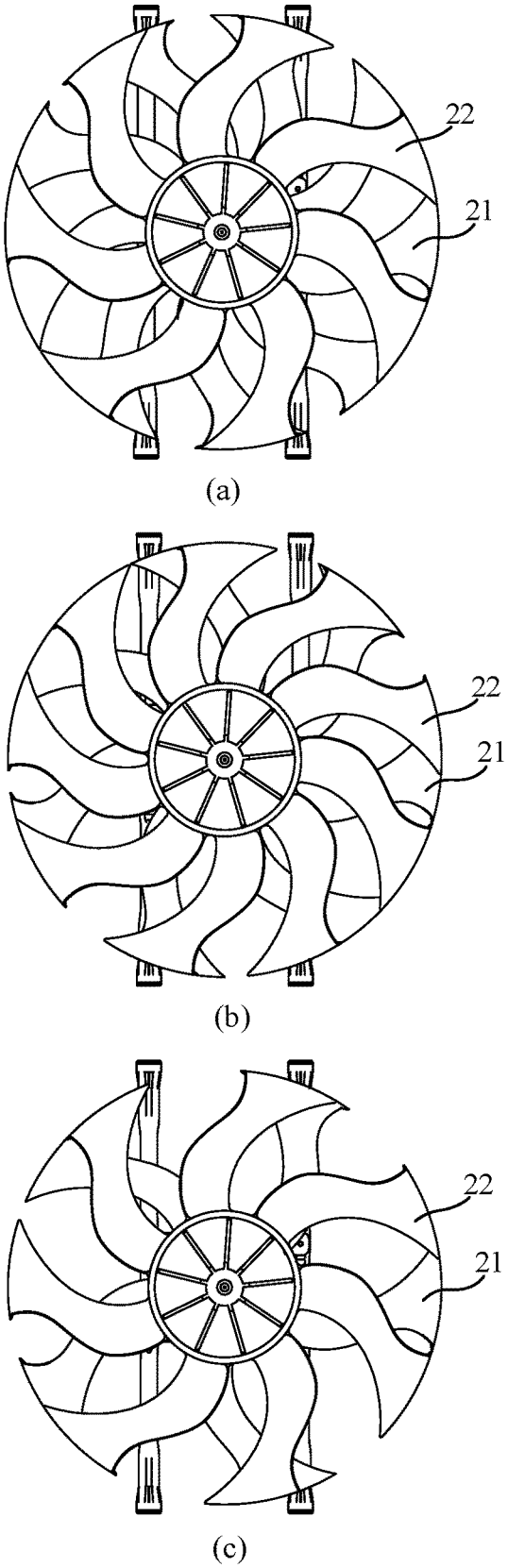
FIG. 32 is a structural schematic view of a first wind wheel and a second wind wheel according to some embodiments of the present disclosure.

Referring to FIG. 32, which including three parts (a), (b), and (c). Shown in (a), the number of blades of the first wind wheel 110 is 9 and the number of blades of the second wind wheel 120 is 7. Shown in (b), the number of blades of the first wind wheel 110 is 7 and the number of blades of the second wind wheel 120 is 9. Shown in (c), the number of blades of the first wind wheel 110 is 5 and the number of blades of the second wind wheel 120 is 7.

It should be noted that the diameters of the first wind wheel 110 and the second wind wheel 120 in the embodiments may be the same or different, and the number of blades of both satisfy the above relationship.

In some embodiments, considering a presence of the leakage vortex of a blade tip of the second wind wheel 120 (i.e., the vortex is generated on the outer side of the blade tip of the second wind wheel 120), the vortex of the blade tip leakage is one of the main sources of the aerodynamic noise of the wind wheel, which means that the second wind wheel 120 is the main source of noise. Therefore, the number of blades of the first wind wheel 110 is greater than the number of blades of the second wind wheel 120, while ensuring the performance of the fan apparatus 100. Therefore, the number of blades of the second wind wheel 120 is less, which may effectively reduce the aerodynamic noise caused by the second wind wheel 120, while the number of blades of the first wind wheel 110 is greater to ensure the performance of the fan apparatus 100 (including air volume, air output efficiency, etc.), which may enable the performance of the fan apparatus 100 to meet the requirements.

In other embodiments, a relationship between the number n1 of blades of the first wind wheel 110 and the number n2 of blades of the second wind wheel 120 is configured as: $|hn1-sn2|\geq 2, h,s \in (1,2,3)$. Therefore, the noise caused by mutual interference between the first wind wheel 110 and the second wind wheel 120 may be maintained at a minimum level, and the beat vibration may be avoided as much as possible.

In some embodiments, the number of blades of the first wind wheel 110 and the number of blades of the second wind wheel 120 are positively related to their respective diameters. Specifically, the greater the diameter of the first wind wheel 110, the greater the number of blades of the first wind wheel 110; the greater the diameter of the second wind wheel 120, the greater the number of blades of the second wind wheel 120.

At a certain rotation speed, with the diameter of the wind wheel greater and the number of blades greater, the air volume is greater. Therefore, the number of blades of the first wind wheel 110 and the number of blades of the second wind wheel 120 in the embodiments are positively correlated with their respective diameters, so that the number of blades of the first wind wheel 110 and the number of blades of the second wind wheel 120 match with their respective diameters to improve the performance of the first wind wheel 110 and the second wind wheel 120.

In some embodiments, the number of blades of the first wind wheel 110 and the number of blades of the second wind wheel 120 are from 5 to 15. In this way, the production cost of the fan apparatus 100 and the performance of the first wind wheel 110 and the second wind wheel 120 may be optimized.

Referring to FIGS. 18 to 23, the following is an example of the above embodiments of the fan apparatus 100 including the first wind wheel 110 and the second wind wheel 120.

In some embodiments, the fan apparatus 100 further includes a guide lobe 150, which is axially spaced from the first wind wheel 110 and the second wind wheel 120. Further, the guide lobe 150, the first wind wheel 110, and the second wind wheel 120 are arranged coaxially, which means the central axes of the guide lobe 150, the first wind wheel 110 and the second wind wheel 120 coincide.

The effect of the guide lobe 150 is different depending on different position arranged on the fan apparatus. For example, when the guide lobe 150 is arranged on the inlet side, the bending direction of the blades of the guide lobe 150 is opposite to the bending direction of the blades of the first wind wheel 110, and the guide lobe 150 is configured to provide pre-spin, which means to provide pre-spin flow for the incoming airflow from the first wind wheel 110, so as to rectify the complex incoming airflow, thereby reducing energy consumption and increasing air volume; and when the guide lobe 150 is arranged on the outlet side, the bending direction of the blades of the guide lobe 150 is opposite to the bending direction of the blades of the second wind wheel 120, and the guide wheel 150 is configured to recover the rotational velocity component of the airflow passing through the second wind wheel 120, so that the airflow is output along the axial direction of the fan apparatus 100 as much as possible, which is conducive to increasing the static pressure as well as the airflow, thereby improving the efficiency of the fan apparatus 100. This will be described in detail below.

In some embodiments, the number of blades of the first wind wheel 110, the number of blades of the second wind wheel 120, and the number of blades of the guide lobe 150 are prime numbers of each other. For example, the number of blades of the first wind wheel 110 is 9, the number of blades of the second wind wheel 120 is 7, the number of blades of the guide lobe 150 is 11, etc.

Based on the method above, since the number of blades of the guide lobe 150 is related to the pressure rising effect of the fan apparatus 100, by the design that the number of blades of the first wind wheel 110, the number of blades of the second wind wheel 120 and the number of blades of the guide lobe 150 are prime numbers of each other, the number of blades of the first wind wheel 110, the number of blades of the second wind wheel 120 and the number of blades of the guide lobe 150 match with each other, so that the fan apparatus 100 achieves the best pressure rising effect.

In some embodiments, a relationship among the number n1 of blades of the first wind wheel 110, the number n2 of blades of the second wind wheel 120, and the number n3 of blades of the guide lobe 150 is configured as: $n1 \leq n2$, $n2 \leq n3 \leq 2n1$, or $n2 \leq n1$, $n1 \leq n3 \leq 2n2$. Based on the practical engineering experience, the number of blades of the first wind wheel 110, the number of the blades of the second wind wheel 120 and the number of the blades of the guide lobe satisfy the above relationship, which ensure that the guide lobe 150 has sufficient consistency to ensure that the guide lobe 150 has a good rectification and pressure rising effect. In addition, the arrangement satisfying the above relationship of the numbers of blades limits the number of new noise sources introduced, which may effectively control the overall noise of the fan apparatus 100.

Preferably, a relationship among the number n1 of blades of the first wind wheel 110, the number n2 of blades of the second wind wheel 120, and the number n3 of blades of the guide lobe 150 is configured as: $n2 \leq n1$, $n1 \leq n3 \leq 2n2$. In this case, since the first wind wheel 110 is relatively close to the inlet side and the second wind wheel 120 is relatively close to the outlet side, considering that the second wind wheel 120 is the main source of aerodynamic noise, it is conducive to reducing the noise produced by the rotation of the second wind wheel 120 by configuring the number of blades of the second wind wheel 120 less than the number of blades of the first wind wheel 110. Further, in the case that the number of blades of the first wind wheel 110 is equal to the number of blades of the second wind wheel 120, the performance of the first wind wheel 110 and the second wind wheel 120 are matched, thereby maximizing the performance of the first wind wheel 110 and the second wind wheel 120 while reducing the cost of the fan apparatus 100. In addition, the number of blades of the guide lobe 150, as shown above, maximizes the pressure rising effect and contributes to improving the performance of the fan apparatus 100.

In an embodiment, the number of blades of the guide lobe 150 is from 6 to 17. In this case, the production cost of the fan apparatus 100 and the performance of the guide lobe 150 may be optimized.

The above is only some embodiments of the present disclosure, not to limit the scope of the present disclosure. Any equivalent structure or equivalent process transformation using the contents and the accompanying drawings of the present disclosure, or directly or indirectly applied in other related technical fields, are included in the scope of the present disclosure.

What is claimed is:

1. A fan apparatus, comprising:

a first wind wheel and a second wind wheel, axially arranged at an interval;

wherein a spacing S1 between the first wind wheel and the second wind wheel is configured as: $S1<H1+H2/2$, where H1 is a length of the first wind wheel along the axial direction, and H2 is a length of the second wheel along the axial direction;

wherein the fan apparatus further comprises a guide lobe spaced axially from the first wind wheel and the second wind wheel, wherein each of the first wind wheel, the second wind wheel, and the guide lobe comprises a plurality of blades; a number n1 of the plurality of blades in the first wind wheel, a number n2 of the plurality of blades in the second wind wheel, and a number n3 of the plurality of blades in the guide lobe satisfies $n1 \leq n2$, $n2 \leq n3 \leq 2n1$; or $n2 \leq n1, n1 \leq n3 \leq 2n2$.

2. The fan apparatus according to claim 1, wherein the spacing S1 satisfies $20\ mm \leq S1 \leq 70\ mm$.

3. The fan apparatus according to claim 1, wherein the fan apparatus further comprises a deflector cover, sleeved on a periphery of the first wind wheel and the second wind wheel; wherein the deflector cover comprise a body, and the first wind wheel is partially arranged in the body and near an inlet side of the body; the second wind wheel is at least partially arranged in the body and near an outlet side of the body; a relationship between a spacing S2 between an inlet side of the first wind wheel and the inlet side of the body and the length H1 of the first wind wheel along the axial direction is configured as: $0.4<S2/H1<0.7$.

4. The fan apparatus according to claim 3, wherein a spacing S3 between an outlet side of the second wind wheel is configured as: $0<H2/S3<0.25$, and H2 is a length of the second wind wheel along the axial direction.

5. The fan apparatus according to claim 3, wherein the body is uniform and has a first diameter along the axial direction; the deflector cover comprises a first tapering portion connected to the inlet side of the body and a second tapering portion connected to the outlet side of the body; a spacing S3 between the outlet side of the second wind wheel and the outlet side of the body and a length H3 of the second tapering portion along the axial direction satisfies $S3<H3$.

6. The fan apparatus according to claim 5, wherein a length H4 of the first tapering portion along the axial direction and an outer diameter D1 of the first wind wheel satisfy: $0.06<D1/H4<0.2$.

7. The fan apparatus according to claim 1, wherein a pressure rising distribution ratio between the first wind wheel and the second wind wheel is between 0.6 to 1.

8. The fan apparatus according to claim 1, wherein the fan apparatus further comprises a guide lobe spaced axially from the first wind wheel and the second wind wheel, wherein a length H5 of the guide lobe along the axial direction satisfies $0.25\ (H1+H2) \leq H5 \leq 0.75\ (H1+H2)$.

9. The fan apparatus according to claim 8, wherein the guide lobe is arranged on a side of the first wind wheel back from the second wind wheel; a distance S4 between the guide lobe and the first wind wheel along the axial direction satisfies $0.05\ (H1+H2) \leq S4 \leq 0.25\ (H1+H2)$; or the guide lobe is arranged on a side of the second wind wheel back from the first wind wheel; a distance S5 between the guide lobe and the second wind wheel along the axial direction satisfies: $0.05\ (H1+H2) \leq S5 \leq 0.25\ (H1+H2)$.

10. The fan apparatus according to claim 1, wherein the guide lobe is arranged on a side of the first wind wheel back from the second wind wheel; a bending direction of the plurality of blades in the guide lobe is opposite to a bending direction of the plurality of blades in the first wind wheel; the side of the first wind wheel back from the second wind wheel is an inlet side, and a side of the second wind wheel back from the first wind wheel is an outlet side.

11. The fan apparatus according to claim 1, wherein the guide lobe is arranged on a side of the second wind wheel back from the first wind wheel; a bending direction of the plurality of blades in the guide lobe is opposite to a bending direction of the plurality of blades in the second wind wheel; a side of the first wind wheel back from the second wind wheel is an inlet side, and the side of the second wind wheel back from the first wind wheel is an outlet side.

12. The fan apparatus according to claim 1, wherein the number of the plurality of blades in the first wind wheel, the number of the plurality of blades in the second wind wheel, and the number of the plurality of blades in the guide lobe are prime numbers of each other.

13. The fan apparatus according to claim 1, wherein a difference between the number of the plurality of blades in the first wind wheel and the number of the plurality of blades in the second wheel is 2.

14. The fan apparatus according to claim 13, wherein a diameter of the first wind wheel and a diameter of the second wind wheel are each greater than or equal to a first threshold, and a greater value between the number of the plurality of blades in the first wind wheel and the number of the plurality of blades in the second wind wheel is greater than or equal to a second threshold; or the diameter of the first wind wheel and the diameter of the second wind wheel are each less than or equal to the first threshold, and a greater value between the number of the plurality of blades in the first wind wheel and the number of the plurality of blades in the second wind wheel is less than or equal to a third threshold; the second threshold is greater than the third threshold.

15. The fan apparatus according to claim 1, wherein a side of the first wind wheel back from the second wind wheel is an inlet side, and a side of the second wind wheel back from the first wind wheel is an outlet side; the number of the plurality of blades in the first wind wheel is greater than the number of the plurality of blades in the second wind wheel.

16. The fan apparatus according to claim 1, wherein a side of the first wind wheel back from the second wind wheel is an inlet side, and a side of the second wind wheel back from the first wind wheel is an outlet side; the number n1 and the number n2 satisfy $|hn1-sn2| \geq 2$, $h, s \in (1,2,3)$.

17. The fan apparatus according to claim 1, wherein the number of the plurality of blades in the first wind wheel is positively related to a diameter of the first wind wheel; the number of the plurality of blades in the second wind wheel is positively related to the diameter of the second wind wheel.

18. The fan apparatus according to claim 1, wherein a rotation direction of the first wind wheel is opposite to a rotation direction of the second wind wheel.

* * * * *